US007384671B2

(12) United States Patent
Kittle et al.

(10) Patent No.: US 7,384,671 B2
(45) **Date of Patent: *Jun. 10, 2008**

(54) APPARATUS AND PROCESS FOR FORMING A POWDER COATING ON A SUBSTRATE USING A FLUIDISED BED AND TRIBOSTATIC CHARGING OF THE POWDER COATING COMPOSITION

(75) Inventors: Kevin Jeffrey Kittle, Durham (GB); Michele Falcone, Como (IT)

(73) Assignee: Akzo Nobel Coatings International B.V., Arnhem (NL)

( * ) Notice: Subject to any disclaimer, the term of this patent is extended or adjusted under 35 U.S.C. 154(b) by 19 days.

This patent is subject to a terminal disclaimer.

(21) Appl. No.: 10/534,113

(22) PCT Filed: Dec. 11, 2003

(86) PCT No.: PCT/EP03/14165

§ 371 (c)(1),
(2), (4) Date: Sep. 19, 2005

(87) PCT Pub. No.: WO2004/052557

PCT Pub. Date: Jun. 24, 2004

(65) Prior Publication Data

US 2006/0057390 A1 Mar. 16, 2006

(30) Foreign Application Priority Data

Dec. 12, 2002 (GB) ..... 0229004.7

(51) Int. Cl.
*B05D 1/04* (2006.01)
*B05B 1/047* (2006.01)

(52) U.S. Cl. ..... 427/459; 427/460; 427/461; 118/634

(58) Field of Classification Search ..... 427/459, 427/460, 461; 118/634
See application file for complete search history.

(56) References Cited

U.S. PATENT DOCUMENTS 3,248,253 A * 4/1966 Barford et al. ..... 427/459

(Continued)

FOREIGN PATENT DOCUMENTS

FR 2 720 959 A1 12/1995

(Continued)

OTHER PUBLICATIONS

Liberto, N. P. (Ed.), Powder Coating The Complete Finisher's Handbook, pp. 88-89, 1994.

*Primary Examiner*—Fred J. Parker
(74) *Attorney, Agent, or Firm*—Kenyon & Kenyon LLP

(57) ABSTRACT

An apparatus and process for forming a coating on a substrate, including establishing a fluidised-bed having a fluidising gas and a powder coating composition, immersing the substrate wholly or partly in the fluidised bed, the substrate being either electrically isolated or earthed, providing an electrically conductive electrode, to which a voltage is applied, positioned to influence the extent to which charged particles adhere to a region of the substrate, withdrawing the substrate from the fluidised-bed and forming the adherent particles into a continuous coating over at least part of the substrates. The apparatus is arranged and the process is conducted such that the maximum potential gradient existing in the fluidised bed is below the ionisation potential of the fluidising gas.

48 Claims, 9 Drawing Sheets

U.S. PATENT DOCUMENTS

Figure 1:
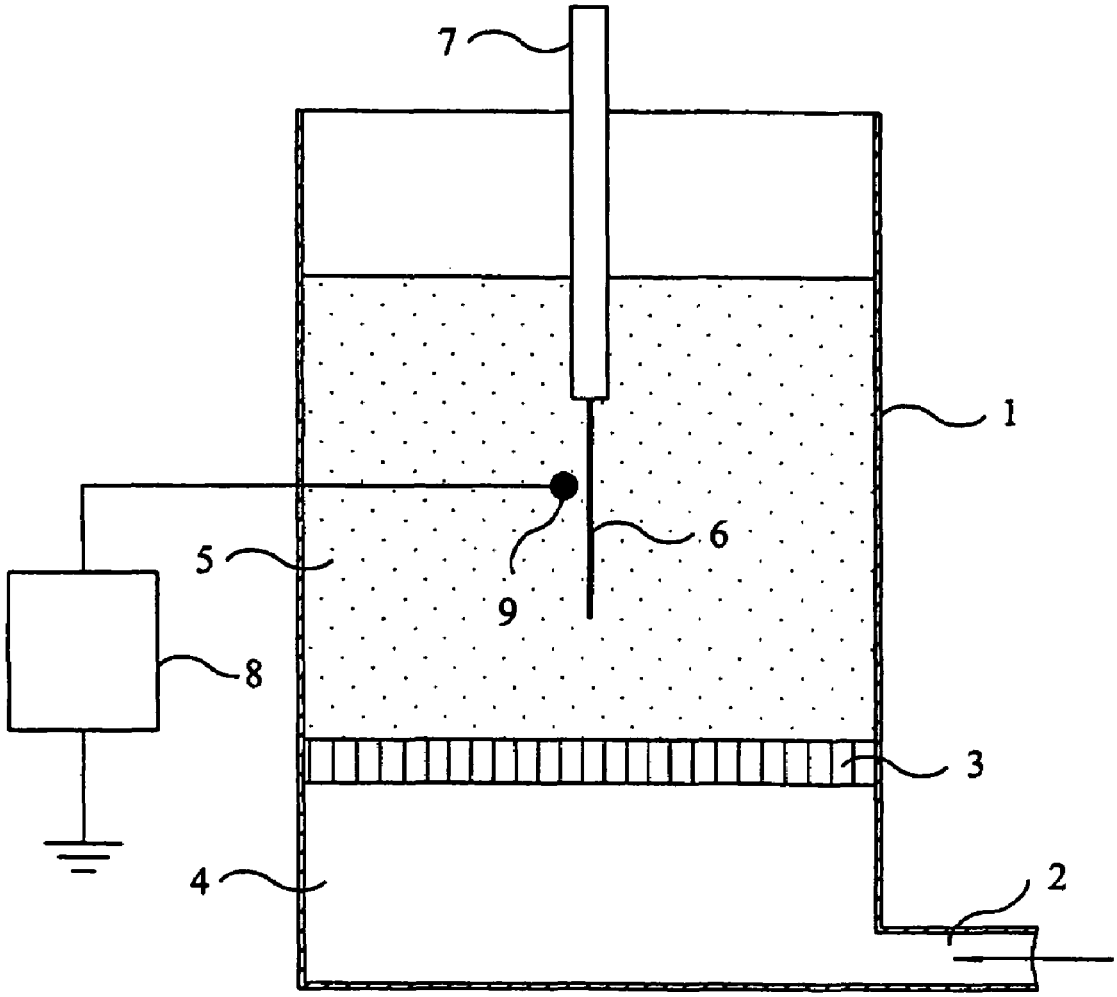

| | | | | |
|---|---|---|---|---|
| 3,396,699 | A | 8/1968 | Beebe et al. | |
| 3,670,699 | A | 6/1972 | Sargent | |
| 3,690,298 | A | 9/1972 | Venturi | |
| 3,817,211 | A | 6/1974 | Brown et al. | |
| 3,871,328 | A | 3/1975 | English | |
| 5,714,007 | A * | 2/1998 | Pletcher et al. | 118/629 |
| 5,877,231 | A * | 3/1999 | Biller et al. | 522/93 |
| 6,280,798 | B1 | 8/2001 | Ring et al. | |
| 6,506,455 | B1 | 1/2003 | Bru et al. | |

FOREIGN PATENT DOCUMENTS

| | | |
|---|---|---|
| WO | WO 94/11446 | 5/1994 |
| WO | WO 99/30838 | 6/1999 |
| WO | WO 00/01775 | 1/2000 |
| WO | WO 01/59017 | 8/2001 |
| WO | WO 02/098577 A1 | 12/2002 |

* cited by examiner

APPARATUS AND PROCESS FOR FORMING A POWDER COATING ON A SUBSTRATE USING A FLUIDISED BED AND TRIBOSTATIC CHARGING OF THE POWDER COATING COMPOSITION

The invention relates to an apparatus and a process for the application of powder coating compositions to substrates.

Powder coatings are solid compositions which are usually applied by an electrostatic application process in which the powder coating particles are electrostatically charged and caused to adhere to a substrate which is usually metallic and electrically earthed. The charging of the powder coating particles is usually achieved by interaction of the particles with ionised air (corona charging) or by friction (triboelectric, tribostatic or "tribo" charging) employing a spray gun. The charged particles are transported in air towards the substrate and their final deposition is influenced, inter alia, by the electric field lines that are generated between the spray gun and the substrate.

A disadvantage of the corona charging process is that there are difficulties in coating substrates having complicated shapes, especially substrates having recessed portions, resulting from restricted access of the electric field lines into recessed locations in the substrate (the Faraday cage effect). The Faraday cage effect is less evident in the case of the tribostatic charging process but that process has other drawbacks.

As an alternative to electrostatic spray processes, powder coating compositions may be applied by processes in which the substrate is preheated (typically to 200° C.-400° C.) and dipped into a fluidised-bed of the powder coating composition. The powder particles that come into contact with the preheated substrate melt and adhere to the surface of the substrate. In the case of thermosetting powder coating compositions, the initially-coated substrate may be subjected to further heating to complete the curing of the applied coating. Such post-heating may not be necessary in the case of thermoplastic powder coating compositions.

Fluidised-bed processes eliminate the Faraday cage effect, thereby enabling recessed portions in the substrate workpiece to be coated, and are attractive in other respects, but are known to have the disadvantage that the applied coatings are substantially thicker than those obtainable by electrostatic coating processes.

Another alternative application technique for powder coating compositions is the so-called electrostatic fluidised-bed process, in which air is ionised by means of charging electrodes arranged in a fluidising chamber or, more usually, in a plenum chamber lying below a porous air-distribution membrane. The ionised air charges the powder particles, which acquire an overall upwards motion as a result of electrostatic repulsion of identically charged particles. The effect is that a cloud of charged powder particles is formed above the surface of the fluidised-bed. The substrate is usually earthed and is introduced into the cloud of powder particles some of which are deposited on the substrate surface by electrostatic attraction. No preheating of the substrate is required in the electrostatic fluidised-bed process.

The electrostatic fluidised-bed process is especially suitable for coating small articles, because the rate of deposition of the powder particles is reduced as the article is moved away from the surface of the charged bed. Also, as in the case of the traditional fluidised-bed process, the powder is confined to an enclosure and there is no need to provide equipment for the recycling and re-blending of over-spray that is not deposited on the substrate. As in the case of the corona-charging electrostatic process, however, there is a strong electric field between the charging electrodes and the substrate and, as a result, the Faraday cage effect operates to a certain extent and leads to poor deposition of powder particles into recessed locations on the substrate.

The invention provides an apparatus for performing a process for forming a coating on a substrate, including:

a fluidising chamber for establishing a fluidised-bed of a powder coating composition, thereby effecting tribostatic charging of the powder coating composition, means for immersing the substrate wholly or partly in the fluidised bed, whereby tribostatically charged particles of the powder coating composition adhere to the substrate, the substrate being either electrically isolated or earthed, an electrically conductive electrode, to which a voltage is applied, positioned to influence the extent to which charged particles adhere to a region of the substrate, means for applying the voltage to the electrode, means for withdrawing the substrate from the fluidised-bed and means for forming the adherent particles into a continuous coating over at least part of the substrate, the apparatus being arranged to operate without ionisation or corona effects in the fluidised bed.

The electrode exerts its influence over a region of the substrate and influences the coating of the said region in accordance with the proximity of the electrode to the region and the voltage applied to the electrode.

One arrangement of the apparatus includes a second electrode to which is applied a voltage that is of polarity opposite to the first-identified voltage, the first-identified electrode and the second electrode being on opposite sides of the substrate and the second electrode being positioned to influence the extent to which charged particles adhere to a region of the substrate, and means for applying a voltage of the opposite polarity to the second electrode.

Another arrangement of the apparatus includes at least one further electrode adjacent to the first-identified electrode, the further electrode or electrodes being positioned to influence the extent to which charged particles adhere to a respective region of the substrate or respective regions of the substrate, and means for applying a voltage of the same polarity as the first-identified voltage to the further electrode or electrodes.

Other arrangements of the apparatus Include a plurality of further electrodes, wherein the further electrodes encompass the substrate.

In one arrangement, the first-identified electrode is in the form of a rod.

In another arrangement, the first-identified electrode is in the form of a plate.

Preferably, in an arrangement including at least one further electrode, the further electrode is in the form of a plate and other further electrodes are in the form of plates.

The first-identified electrode and any other electrodes are such that, in operation, at the applied voltage or voltages, ionisation or corona conditions are not established in the apparatus.

Thus, for example, the first-identfied and any other electrodes include only relatively smooth surfaces unsuitable for producing ionisation or corona conditions and edges and corners, resulting from the shape of the electrode or electrodes, are rounded as a means of avoiding ionisation or corona conditions. Alternatively or additionally, edges and corners are masked by insulating material in order to avoid ionisation or corona conditions.

The spacing between the electrode or electrodes and the substrate and the voltages applied to the electrode or electrodes are such that, in operation, ionisation or corona conditions are not established in the apparatus.

By way of example, the spacing between the electrode or electrodes and the substrate may be 10 cm and the voltage applied to the electrode or electrodes may be 5 kV, resulting in a potential gradient of 0.5 kV/cm, which is well below the potential gradient required for ionisation or corona conditions.

A potential gradient of 0.5 kV/cm may, of course, be achieved for other separations between the substrate and electrode or electrodes by adjusting the voltage applied to the electrode or electrodes accordingly.

Potential gradients larger than 0.5 kV/cm but still below potential gradients establishing ionisation or corona conditions, may also be used, the spacing between the substrate and the electrode or electrodes and the voltage applied to the electrode or electrodes, being selected as appropriate.

In operation, for example, the potential gradient between the electrode or electrodes and the substrate may be of the order of between 0.1 kV/cm and 5 kV/cm.

The apparatus may be operated, for example, with a potential gradient of the order of between 0.1 kV/cm and 0.5 kV/cm.

Alternatively, the apparatus may be operated, for example, with a potential gradient of the order of between 0.2 kV/cm and 1 kV/cm.

In a particular arrangement, according to the invention, the first-identified electrode and the plurality of further electrodes are arranged in the form of a "shell" which at least partly encloses the substrate. Such a shell may be continuous or discontinuous.

In yet another arrangement, the first-identified electrode forms a shell for the substrate.

In one arrangement including a shell, the shell consists of or includes sheet material.

In another arrangement including a shell, at least part of the shell consists of an array of rods.

The shell may be in the form of a continuous sheet, forming a close-fitting enclosure for most or all of the substrate, while meeting the requirements indicated above for the spacing between the electrode or electrodes and the substrate Alternatively, the shell may be in the form of a plurality of separate sheets, forming a close-fitting enclosure for most or all of the substrate, and the boundaries of the sheets may overlap one another but need not be overlapping, while meeting the requirements indicated above for the spacing between the electrode or electrodes and the substrate.

As another alternative, the shell may be formed by a plurality of rods, forming a close-fitting enclosure for most or all of the substrate, and the rods may overlap one another but need not be overlapping. There may be an array formed by two sets of rods which are orthogonal to each other.

In arrangements including a shell, the form of the shell may be tubular, tubular including an end closure member at one end or tubular including end closure members at both ends.

Alternatively, the form of the shell may be cylindrical and may, for example, have a circular transverse cross-section, an oval transverse cross-section or a rectangular transverse cross-section.

In particular arrangements of the shell, the shell has a plurality of electrically isolated portions and the apparatus includes means for applying respective voltages to the separate portions of the shell.

In one form of the apparatus, the fluidised-bed includes a fluidising chamber at least a part of which is conductive and the apparatus includes means for applying a voltage to the conductive part of the fluidising chamber.

The invention also provides a process for forming a coating on a substrate, including the steps of:

establishing a fluidised bed of a powder coating composition, thereby effecting tribostatic charging of the powder coating composition, immersing the substrate wholly or partly in the fluidised bed, whereby tribostatically charged particles of the powder coating composition adhere to the substrate, the substrate being either electrically isolated or earthed, providing an electrically conductive electrode in the fluidised bed, applying a voltage to the electrically conductive electrode, the electrode being positioned, in relation to the substrate, where the extent to which charged particles adhere to regions of the substrate is influenced by the electrode, withdrawing the substrate from the fluidised-bed and forming the adherent particles into a continuous coating over at least part of the substrate, the process being conducted without ionisation or corona effects in the fluidised bed.

In the process, the electrode exerts its influence over a region of the substrate and influences the coating of the said region in accordance with the proximity of the electrode to the region and the voltage applied to the electrode One form of the process includes the provision of a second electrode on the opposite side of the substrate relative to the first-identified electrode, the second electrode being positioned to influence the extent to which charged particles adhere to a region of the substrate, and applying, to the second electrode, a voltage that is of polarity opposite to the first-identified voltage.

An alternative form of the process includes the provision of at least one further electrode adjacent to the first-identified electrode, the further electrode or electrodes being positioned to influence the extent to which charged particles adhere to a respective region of the substrate or respective regions of the substrate, and applying, to the further electrode or electrodes, a voltage of the same polarity as the first-identified voltage.

In the process of the present invention, particles of the powder coating composition adhere to the substrate as a result of the frictional charging (triboelectric, tribostatic or "tribo" charging) of the particles as they rub against one another in circulating in the fluidised bed.

The process of the present invention is conducted without ionisation or corona effects in the fluidised bed.

In the process of the invention, the substrate may be electrically conductive (metal or another conductive material), electrically non-conductive or poorly conductive.

Thus, for example, the substrate may comprise a medium density fibreboard (MDF), wood or a wood product.

Alternatively, the substrate may comprise a plastics material or a plastics material including an electrically conductive additive.

The plastics material may comprise polyamide or a highly insulating plastics material, for example, polycarbonate.

A plastics substrate may be immersed in the fluidised bed as it is or, alternatively, the substrate may be pre-charged before immersion in the fluidised bed, and the process may include the step of heating the plastics material to a temperature below its melting point and below the transition point of the powder coating composition, before immersing the substrate in the fluidised bed.

In the case where a plastics substrate is immersed in the fluidised bed as it is, heating it serves the purpose of reducing its surface resistance.

In the case where a plastics substrate is pre-charged before immersion in the fluidised bed, the principal purpose for heating it is to equalise the charge over the whole surface.

As an alternative to heating or in addition to heating, the surface of a pre-charged plastics substrate may be moistened in order to equalise the charge on it.

The voltage applied to the shell and, when included, the electrically conductive part of the fluidising chamber, is sufficient to influence the coating of the substrate by the frictionally charged powder coating particles while resulting in a maximum potential gradient that is insufficient to produce either ionisation or corona effects in the fluidised bed. Air at atmospheric pressure usually serves as the gas in the fluidised bed but other gases may be used, for example, nitrogen or helium.

As compared with the electrostatic fluidised-bed process in which a substantial electric field is generated between charging electrodes and the substrate, the process of the present invention achieves good coating in recessed portions of metal and other substrates of relatively high conductivity. The process is notably superior to the electrostatic fluidised-bed process in the uniformity of coating achieved irrespective of the shape of a highly conductive substrate.

As further compared with the electrostatic fluidised-bed process in which a substantial electric field is generated between charging electrodes and the substrate, the process of the present invention achieves good coating in substrates including fibrous material without any tendency for the fibrous material to stand on end as might occur in a substantial electric field.

As compared with traditional fluidised-bed application processes, the process of the invention offers the possibility of coating materials including MDF, plywood and plastics for which heating to temperatures of 200 to 400° C. is undesirable. Also, the process achieves thin coatings on MDF, plywood and plastics materials in a controlled manner since inter-particle charging becomes more effective as particle sizes are reduced.

Improvements in efficiency as particle sizes are reduced stands in contrast with the powder coating process using a triboelectric gun where efficiency falls as particle sizes are reduced.

In addition to MDF, wood, wood products, plastics materials, plastics materials including electrically conductive additives, polyamide, highly insulating plastics materials, for example, polycarbonate provide suitable substrates.

Substrates having a surface resistance of between $10^3$ ohms/square, say, and $10^{11}$ ohms/square, say, may be considered as poorly conductive while substrates having a surface resistance above $10^{11}$ ohms/square, say, may be considered as non-conductive.

A block of MDF may have a surface resistance of the order of between $10^3$ ohms/square and $10^{11}$ ohms/square depending on its moisture content, a surface resistance of the order of $10^3$ ohms/square corresponding to a higher moisture content than does a surface resistance of the order of $10^{11}$ ohms/square.

Wood and wood products may be expected to have a surface resistance of the order of between $10^3$ ohms/square and $10^{11}$ ohms/square depending on the type of wood and its moisture content.

Plastics materials including electrically conductive additives and various plastics materials without electrically conductive additives may have a surface resistance of the order of between $10^3$ and $10^{11}$ ohms/square, corresponding to poorly conductive, depending on the material and, where included, the additive or additives.

Highly insulating plastics materials including, for example, polyamide and polycarbonate may be expected to have a surface resistance of an order of above $10^{11}$ ohms/square, corresponding to non-conductive.

In addition, poorly conductive substrates may be classified into a lower range of surface resistance of the order of between $10^3$ and $10^5$ ohms/square and an upper range of surface resistance starting slightly above $10^5$ and extending to $10^{11}$ ohms/square. Materials having a surface resistance above $10^{11}$ ohms/square are considered as "insulating".

The substrates disclosed herein are, of course, not restricted to polymers.

The surface resistance of one substrate may be of the order of at least $10^3$ ohms/square, for example:

of the order of between $10^3$ and $10^5$ ohms/square.

of the order of at least $10^2$ ohms/square.

of the order of between $10^5$ and $10^{11}$ ohms/square.

The surface resistance of an insulating substrate may be of the order of at least $10^{11}$ ohms/square.

The surface resistance values given above are as measured by ASTMS Standard D257-93 with 2 kV applied.

The uniformity of the coating may be improved by shaking or vibrating the substrate in order to remove loose particles Conversion of the adherent particles into a continuous coating (including, where appropriate, curing of the applied composition) may be effected by heat treatment and/or by radiant energy, notably infra-red, ultra-violet or electron beam radiation. Compared with traditional fluidised-bed application technology, pre-heating of the substrate is not an essential step in the process of the invention and, preferably, there is no preheating of the substrate prior to immersion in the fluidised bed.

Since the voltage applied to the shell and the fluidising chamber, when a part of the fluidising chamber is electrically conductive, is insufficient to produce either ionisation or corona effects in the fluidised bed, electrical current is unlikely to be drawn when the substrate is electrically isolated and, consequently, it is unlikely that electrical power will be drawn when the substrate is electrically isolated. The current drawn is expected to be less than 1 mA when the substrate is electrically earthed.

Where the substrate comprises a plastics material which shows surface conductivity when at an elevated temperature, there is some advantage in heating the plastics material to a temperature below its melting point and below the glass transition temperature of the powder coating composition before immersing the substrate in the fluidised bed.

Where the substrate comprises a plastics material which shows no substantial surface conductivity even at an elevated temperature, there is some advantage in pre-charging the substrate before immersing it in the fluidised bed.

There may be some advantage in equalising the charge on the pre-charged substrate at the point of immersion and then immersing the substrate in the fluidised bed.

The charge may be equalised by heating the substrate to a temperature below its melting point or by introducing surface moisture on the substrate or both.

The voltage applied to the shell and the fluidising chamber, when a part of the fluidising chamber is electrically conductive, in the process of the present invention is, preferably, a direct voltage, either positive or negative, but the use of an alternating voltage is possible by, say, applying the voltage intermittently at times when it is positive or at times when it is negative. The applied voltage may vary within wide limits according, inter alia, to the size and complexity of the substrate and, when a part of the fluidising chamber is electrically conductive, the fluidising chamber, and the film thickness desired.

The applied voltage will, in general, be in the range of from 10 volts to 100 kilovolts, more usually from 100 volts to 60 kilovolts, preferably from 100 volts to 30 kilovolts, more especially from 100 volts to 10 kilovolts, either positive or negative. The voltage ranges include 10 volts to 100 volts, 100 volts to 5 kilovolts, 5 kilovolts to 60 kilovolts, 15 kilovolts to 35 kilovolts, 5 kilovolts to 30 kilovolts; 30 kilovolts to 60 kilovolts may also be satisfactory.

A direct voltage may be applied continuously or intermittently and the polarity of the applied voltage may be changed during coating. With intermittent application of the voltage, electrification may be effected before the substrate is immersed in the fluidised bed and not discontinued until after the substrate has been removed from the bed. Alternatively, the voltage may be applied only after the substrate has been immersed in the fluidised-bed. Optionally, electrification may be discontinued before the substrate is withdrawn from the fluidised-bed. The magnitude of the applied voltage may be varied during coating.

The fluidising chamber may, of course, be electrically non-conductive.

In order to exclude ionisation and corona conditions, the maximum potential gradient existing in the fluidised bed is below the ionisation potential for the air or other fluidising gas. Factors determining the maximum potential gradient include the applied voltage and the spacing between the shell and the substrate and other elements of the apparatus.

For air at atmospheric pressure, the ionisation potential gradient is 30 kV/cm, and accordingly the maximum potential gradient using air as fluidising gas at atmospheric pressure should be below 30 kV/cm. A similar maximum potential gradient would also be suitable for use with nitrogen or helium as fluidising gas.

Based on these considerations, the maximum potential gradient existing in the fluidised bed may be 29 kV/cm, 27.5, 25, 20, 15, 10, 5 or 0.05 kV/cm.

The minimum potential gradient will in general be at least 0.01 kV/cm or at least 0.05 kV/cm.

Preferably, the substrate is wholly immersed within the fluidised bed during the coating process.

As is stated above, in the process according to the invention, the charging of the powder particles is effected by friction between particles in the fluidised-bed. The friction between the particles in the fluidised-bed leads to bipolar charging of the particles, that is to say, a proportion of the particles will acquire a negative charge and a proportion will acquire a positive charge. The presence of both positively and negatively charged particles in the fluidised-bed might appear to be a disadvantage, especially when electrification is by a direct voltage, but the process of the invention is capable of accommodating the bipolar charging of the particles.

In the case in which electrification is by a direct voltage of a given polarity, electrostatic forces tend to attract powder coating particles of predominantly one polarity onto the substrate. The resulting removal of positively and negatively charged particles at different rates might be expected to lead to a progressive reduction in the proportion of particles of a particular polarity in the body of powder but it is found that, in practice, the remaining powder particles adjust their relative polarities as depletion progresses and charge-balance is maintained.

The preferred period of immersion of the substrate with the fluidising chamber in a charged condition will depend on the size and geometrical complexity of the substrate, the film thickness required, and the magnitude of the applied voltage, being generally in the range of from 10 milliseconds to 10, 20 or 30 minutes, usually 500 milliseconds to 5 minutes, more especially from 1 second to 3 minutes.

Preferably, the substrate is moved in a regular or intermittent manner during its period of immersion in the fluidised bed. The motion may, for example, be linear, rotary and/or oscillatory. As is indicated above, the substrate may, additionally, be shaken or subjected to vibration in order to remove particles adhering only loosely to it. As an alternative to a single immersion, the substrate may be repeatedly immersed and withdrawn until the desired total period of immersion has been achieved.

The pressure of the fluidising gas (normally air) will depend on the bulk of the powder to be fluidised, the fluidity of the powder, the dimensions of the fluidised bed, and the pressure difference across the porous membrane of the fluidising chamber.

The particle size distribution of the powder coating composition may be in the range of from 0 to 150 microns, generally up to 120 microns, with a mean particle size in the range of from 15 to 75 microns, preferably at least 20 to 25 microns, advantageously not exceeding 50 microns, more especially 20 to 45 microns.

Finer size distributions may be preferred, especially where relatively thin applied films are required, for example, compositions in which one or more of the following criteria is satisfied:

a) 95-100% by volume<50 μm
b) 90-100% by volume<40 μm
c) 45-100% by volume<20 μm
d) 5-100% by volume<10 μm
preferably 10-70% by volume<10 μm
e) 1-80% by volume<5 μm
preferably 3-40% by volume<51 μm
f) $d(v)_{50}$ in the range 1.3-32 μm
preferably 8-24 μm $D(v)_{50}$ is the median particle size of the composition. More generally, the volume percentile $d(v)_x$ is the percentage of the total volume of the particles that lies below the stated particle size d. Such data may be obtained using the Mastersizer X laser light-scattering device manufactured by Malvern instruments. If required, data relating to the particle size distribution of the deposited material (before bake/cure) can be obtained by scraping the adhering deposit off the substrate and into the Mastersizer.

The thickness of the applied coating may be in the range of from 5 to 500 microns or 5 to 200 microns or 5 to 150 microns, more especially from 10 to 150 microns, for example from 20 to 100 microns, 20 to 50 microns, 25 to 45 microns, 50 to 60 microns, 60 to 80 microns or 80 to 100 microns or 50 to 150 microns. The principal factor affecting the thickness of the coating is the applied voltage, but the duration of the period of immersion with the fluidising chamber in a charged condition and fluidising air pressure also influence the result.

The process is effective to powder coat a conductive substrate of any shape. The substrate is, preferably, earthed although it may be electrically isolated, that is, without an electrical connection (substrate electrically "floating", that is, its electrical potential is indeterminate).

The process of the invention offers particular benefits in the automotive and other fields where it is desired to coat an article such as a car body at sufficient film build to provide adequate cover for any metal defects before applying an appropriate topcoat. According to previous practice, it has been necessary to apply two separate coats to such articles in order to provide proper preparation for the topcoat. Thus, it has been common practice to apply a first coating of an electropaint to give a barrier film over the whole metal surface, followed by a second coating of a primer surfacer to ensure proper covering of any visible defects. By contrast, the present invention offers the possibility of achieving adequate protective and aesthetic coverage, even of articles of complex geometry, by means of a single coating applied by the process of the invention. Also, the coating process can be adapted to produce relatively high film thickness in a single operation if required.

The invention accordingly provides a process for coating automotive components, in which a first coating derived from a powder coating composition is applied by means of the process of the invention as herein defined, and thereafter a topcoat is applied over the powder coating.

Mention should also be made of applications of the process of the invention in the aerospace industry, where it is of particular advantage to be able to apply uniform coatings at minimum film weights to substrates (especially aluminium or aluminium-alloy substrates) of a wide range of geometric configurations in an environmentally-compliant manner.

The process of the invention is capable of dealing with articles such as radiators, wire baskets and freezer shelves which include welds and projections, providing a uniform coating of powder on the welds and projections as well as on the remainder of the articles, without over-covering of the projections.

The invention is especially suitable for powder coating wire or sheet metal because there need not be an electrical connection to the substrate and the speed of powder coating that is achieved.

The substrate may comprise a block of medium density fibre-board (MDF) or a plastics item or another non-conductive or poorly conductive material and may, in principle, be of any desired shape and size.

In addition to MDF, wood, wood products, plastics materials, plastics materials including electrically conductive additives, polyamide, highly insulating plastics materials and polycarbonate provide suitable substrates.

Advantageously, the substrate is chemically or mechanically cleaned prior to application of the composition.

The process is effective to powder coat substrates that are highly conductive, poorly conductive and highly non-conductive. Highly conductive and poorly conductive substrates can be coated when electrically isolated and when earthed and highly non-conductive substrates are inherently isolated by virtue of their non-conductivity.

In general, the coating process of the invention may be characterised by one or more of the following features:

(i) The coating process is three dimensional and capable of penetrating recesses.

(ii) The applied voltage and the spacing between the substrate and the fluidising chamber are selected so that the maximum potential gradient is below the ionisation potential gradient for the air or other fluidising gas. There are accordingly substantially no ionisation or corona effects.

(iii) The thickness of the powder coating increases as the applied voltage increases. The increase in thickness is achievable without loss of quality up to a point but a progressive loss of smoothness is eventually seen.

(iv) Coating is achievable at room temperature.

(v) Uniform coating on the substrate is achievable irrespective of whether the coating is in a recess, on a projection or on a flat surface of the substrate.

(vi) Smooth coated edges are obtainable.

(vii) Good quality powder coating is achievable in terms of smoothness and the absence of pitting or lumpiness.

(viii) As compared with a fluidised-bed triboelectric process in which a voltage is applied to the substrate, more extensive and consistent coverage is achievable, and good coverage can be achieved more quickly.

(ix) MDF acquires some surface moisture under normal storage conditions and highly satisfactory coating is achieved for MDF including a nominal amount of surface moisture.

(x) There is no tendency for the ends of fibres of MDF to stand up.

(xi) There is no tendency for a pattern on one side of a substrate to be reproduced in the powder on the opposite side of the substrate.

The process is effective to powder coat a plastics substrate which includes an electrically conductive additive, in particular, polyamide with a conductive additive. The plastics substrate is electrically earthed and the above observations, including those for MDF, apply except that there are no fibres and there is no requirement for moisture.

The process is effective to powder coat a plastics substrate which does not include an electrically conductive additive. The substrate is heated in order to make it conductive. During heating the temperature remains below the melting point of the substrate and glass transition temperature of the powder coating. The substrate is electrically earthed, although it may be electrically isolated, that is, without an electrical connection (substrate electrically "floating", that is, its electrical potential is indeterminate).

A powder coating composition according to the invention may contain a single film-forming powder component comprising one or more film-forming resins or may comprise a mixture of two or more such components.

The film-forming resin (polymer) acts as a binder, having the capability of wetting pigments and providing cohesive strength between pigment particles and of wetting or binding to the substrate, and melts and flows in the curing/stoving process after application to the substrate to form a homogeneous film.

The or each powder coating component of a composition of the invention will in general be a thermosetting system, although thermoplastic systems (based, for example, on polyamides) can in principle be used instead.

When a thermosetting resin is used, the solid polymeric binder system generally includes a solid curing agent for the thermosetting resin; alternatively two co-reactive film-forming thermosetting resins may be used.

The film-forming polymer used in the manufacture of the or each component of a thermosetting powder coating composition according to the invention may be one or more selected from carboxy-functional polyester resins, hydroxy-functional polyester resins, epoxy resins, and functional acrylic resins.

A powder coating component of the composition can, for example, be based on a solid polymeric binder system comprising a carboxy-functional polyester film-forming resin used with a polyepoxide curing agent. Such carboxy-functional polyester systems are currently the most widely used powder coatings materials. The polyester generally has an acid value in the range 10-100, a number average molecular weight Mn of 1,500 to 10,000 and a glass transition temperature Tg of from 30° C. to 85° C., preferably at least 40° C. The poly-epoxide can, for example, be a low molecular weight epoxy compound such as triglycidyl isocyanurate (TGIC), a compound such as diglycidyl terephthalate condensed glycidyl ether of bisphenol A or a light-stable epoxy resin. Such a carboxy-functional polyester film-forming resin can alternatively be used with a bis(beta-hydroxyalkylamide) curing agent such as tetrakis(2-hydroxyethyl) adipamide.

Alternatively, a hydroxy-functional polyester can be used with a blocked isocyanate-functional curing agent or an amine-formaldehyde condensate such as, for example, a melamine resin, a urea-formaldehye resin, or a glycol ural formaldehye resin, for example the material "Powderlink 1174" supplied by the Cyanamid Company, or hexahydroxymethyl melamine. A blocked isocyanate curing agent for a hydroxy-functional polyester may, for example, be internally blocked, such as the uretdione type, or may be of the caprolactam-blocked type, for example isophorone diisocyanate.

As a further possibility, an epoxy resin can be used with an amine-functional curing agent such as, for example, dicyandiamide. Instead of an amine-functional curing agent for an epoxy resin, a phenolic material may be used, preferably a material formed by reaction of epichlorohydrin with an excess of bisphenol A (that is to say, a polyphenol made by adducting bisphenol A and an epoxy resin). A functional acrylic resin, for example a carboxy-, hydroxy- or epoxy-functional resin can be used with an appropriate curing agent.

Mixtures of film-forming polymers can be used, for example a carboxy-functional polyester can be used with a carboxy-functional acrylic resin and a curing agent such as a bis(beta-hydroxyalkylamide) which serves to cure both polymers. As further possibilities, for mixed binder systems, a carboxy-, hydroxy- or epoxy-functional acrylic resin may be used with an epoxy resin or a polyester resin (carboxy- or hydroxy-functional). Such resin combinations may be selected so as to be co-curing, for example a carboxy-functional acrylic resin co-cured with an epoxy resin, or a carboxy-functional polyester co-cured with a glycidyl-functional acrylic resin. More usually, however, such mixed binder systems are formulated so as to be cured with a single curing agent (for example, use of a blocked isocyanate to cure a hydroxy-functional acrylic resin and a hydroxy-functional polyester). Another preferred formulation involves the use of a different curing agent for each binder of a mixture of two polymeric binders (for example, an amine-cured epoxy resin used in conijunction with a blocked isocyanate-cured hydroxy-functional acrylic resin).

Other film-forming polymers which may be mentioned include functional fluoropolymers, functional fluorochloropolymers and functional fluoroacrylic polymers, each of which may be hydroxy-functional or carboxy-functional, and may be used as the sole film-forming polymer or in conjunction with one or more functional acrylic, polyester and/or epoxy resins, with appropriate curing agents for the functional polymers.

Other curing agents which may be mentioned include epoxy phenol novolacs and epoxy cresol novolacs; isocyanate curing agents blocked with oximes, such as isopherone diisocyanate blocked with methyl ethyl ketoxime, tetramethylene xylene diisocyanate blocked with acetone oxime, and Desmodur W (dicyclohexylmethane diisocyanate curing agent) blocked with methyl ethyl ketoxime; light-stable epoxy resins such as "Santolink LSE 120" supplied by Monsanto; and alicyclic poly-epoxides such as "EHPE-3150" supplied by Daicel.

A powder coating composition for use according to the invention may be free from added colouring agents, but usually contains one or more such agents (pigments or dyes). Examples of pigments which can be used are inorganic pigments such as titanium dioxide, red and yellow iron oxides, chrome pigments and carbon black and organic pigments such as, for example, phthalocyanine, azo, anthraquinone, thioindigo, isodibenzanthrone, triphendioxane and quinacridone pigments, vat dye pigments and lakes of acid, basic and mordant dyestuffs. Dyes can be used instead of or as well as pigments.

The composition of the invention may also include one or more extenders or fillers, which may be used, inter alia to assist opacity, whilst minimising costs; or more generally as a diluent.

The following ranges should be mentioned for the total pigment/filler/extender content of a powder coating composition according to the invention (disregarding post-blend additives):

0% to 55% by weight,

0% to 50% by weight,

10% to 50% by weight,

0% to 45% by weight, and

25% to 45% by weight

Of the total pigment/filler/extender content, the pigment content will generally be ≦40% by weight of the total composition (disregarding post-blend additives) but proportions up to 45% or even 50% by weight may also be used. Usually a pigment content of 25 to 30 or 35% is used, although in the case of dark colours opacity can be obtained with <10% by weight of pigment.

The composition of the invention may also include one or more performance additives, for example, a flow-promoting agent, a plasticiser, a stabiliser, e .g. against UV degradation, or an anti-gassing agent, such as benzoin, or two or more such additives may be used. The following ranges should be mentioned for the total performance additive content of a powder coating composition according to the invention (disregarding post-blend additives):

0% to 5% by weight,

0% to 3% by weight, and

1% to 2% by weight.

In general, colouring agents, fillers/extenders and performance additives as described above will not be incorporated by post-blending, but will be incorporated before and/or during the extrusion or other homogenisation process.

After application of the powder coating composition to a substrate, conversion of the resulting adherent particles into a continuous coating (including, where appropriate, curing of the applied composition) may be effected by heat treatment and/or by radiant energy, notably infra-red, ultra-violet or electron beam radiation.

The powder is usually cured on the substrate by the application of heat (the process of stoving); the powder particles melt and flow and a film is formed. The curing times and temperatures are interdependent in accordance with the composition formulation that is used, and the following typical ranges may be mentioned:

| Temperature/° C. | Time |
|---|---|
| 280 to 100* | 10 s to 40 min |
| 250 to 150 | 15 s to 30 min |
| 220 to 160 | 5 min to 20 min |

*Temperature down to 90° C. may be used for some resins, especially certain epoxy resins.

The powder coating composition may incorporate, by post-blending, one or more fluidity-assisting additives, for example, those disclosed in WO 94/11446, and especially the preferred additive combination disclosed in that Specification, comprising aluminium oxide and aluminium hydroxide, typically used in proportions in the range of from 1:99 to 99:1 by weight, advantageously from 10:90 to 90:10, preferably from 20:80 to 80:20 or 30:70 to 70:30, for example, from 45:55 to 55:45. Other combinations of the inorganic materials disclosed as post-blended additives in WO 94/11446 may in principle also be used in the practice of the present invention, for example, combinations including silica. Aluminium oxide and silica may in addition be mentioned as materials which can be used singly as post-blended additives. Mention may also be made of the use of wax-coated silica as a post-blended additive as disclosed in WO 00/01775, including combinations thereof with aluminium oxide and/or aluminium hydroxide. Another suitable post-blended additive is a hydrophobic silica, for example, HDK H3004 available from Wacker-Chemie. The term hydrophobic silica denotes a silica of which the surface has been modified by the introduction of silyl groups, for example, polydimethylsiloxane, bonded to the surface.

The total content of post-blended additive(s) incorporated with the powder coating composition will in general be in the range of from 0.01% to 10% by weight, preferably at least 0.1% by weight and not exceeding 1.0% by weight (based on the total weight of the composition without the additive(s)). Combinations of aluminium oxide and aluminium hydroxide (and similar additives) are advantageously used in amounts in the range of from 0.25 to 0.75% by weight, preferably 0.45 to 0.55%, based on the weight of the composition without the additives. Amounts up to 1% or 2% by weight may be used, but problems can arise if too much is used, for example, bit formation and decreased transfer efficiency.

The term "post-blended" in relation to any additive means that the additive has been incorporated after the extrusion or other homogenisation process used in the manufacture of the powder coating composition.

Post-blending of an additive may be achieved, for example, by any of the following dry-blending methods:

a) tumbling into the chip before milling;

b) injection at the mill;

c) introduction at the stage of sieving after milling;

d) post-production blending in a "tumbler" or other suitable mixing device; or e) introduction into the fluidised bed.

Figure 2:
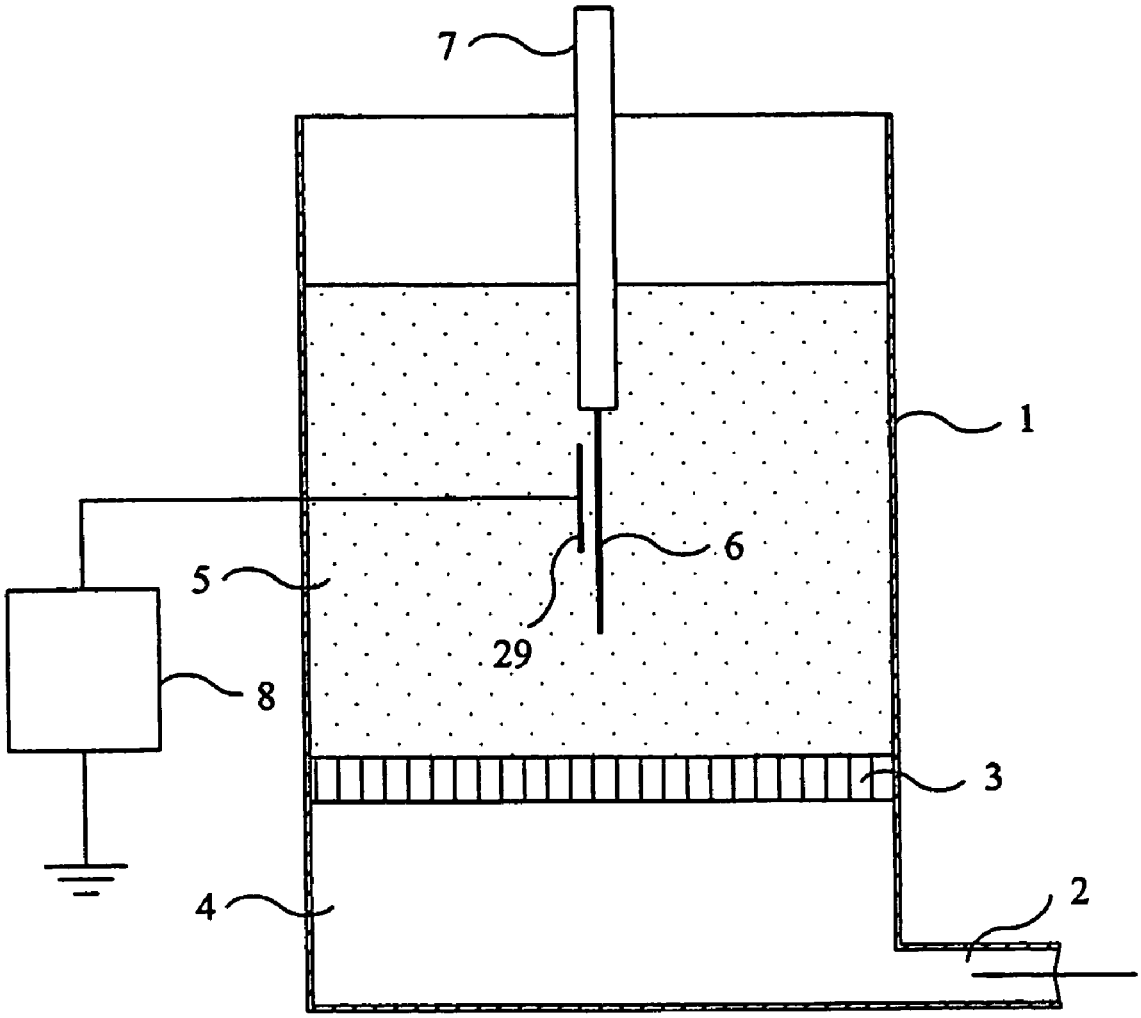
Figure 3:
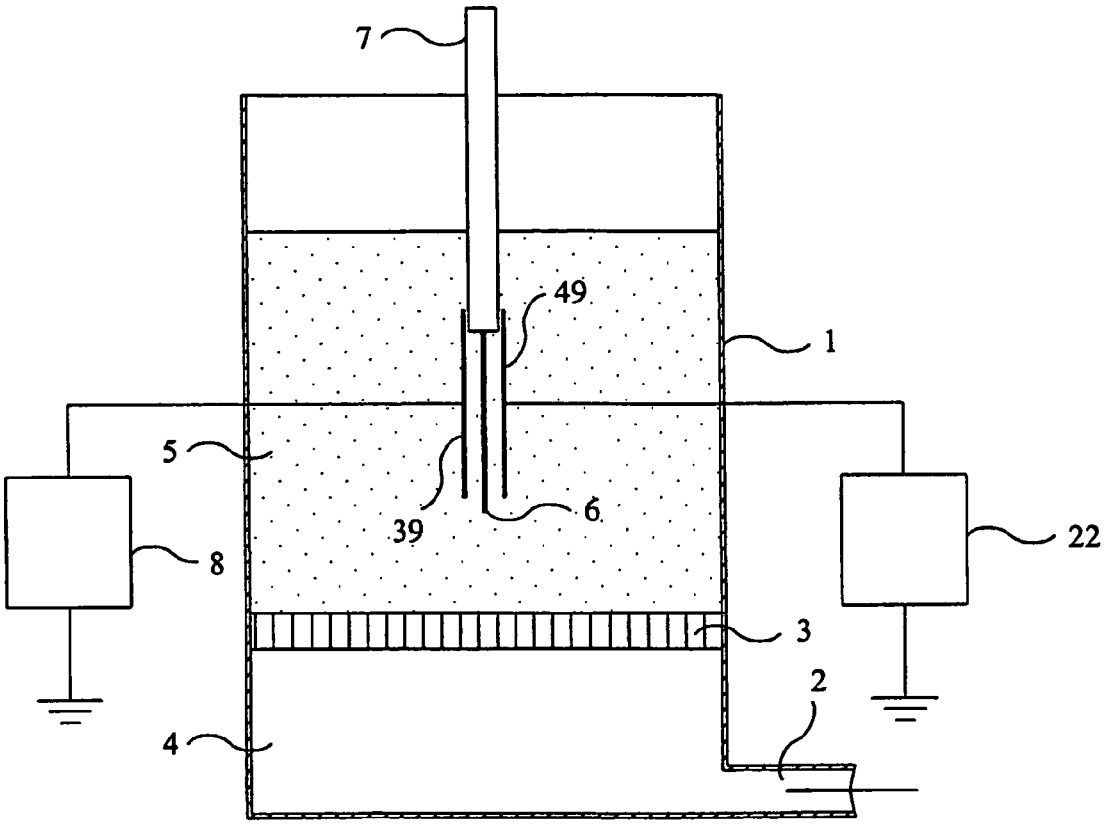
Figure 4:
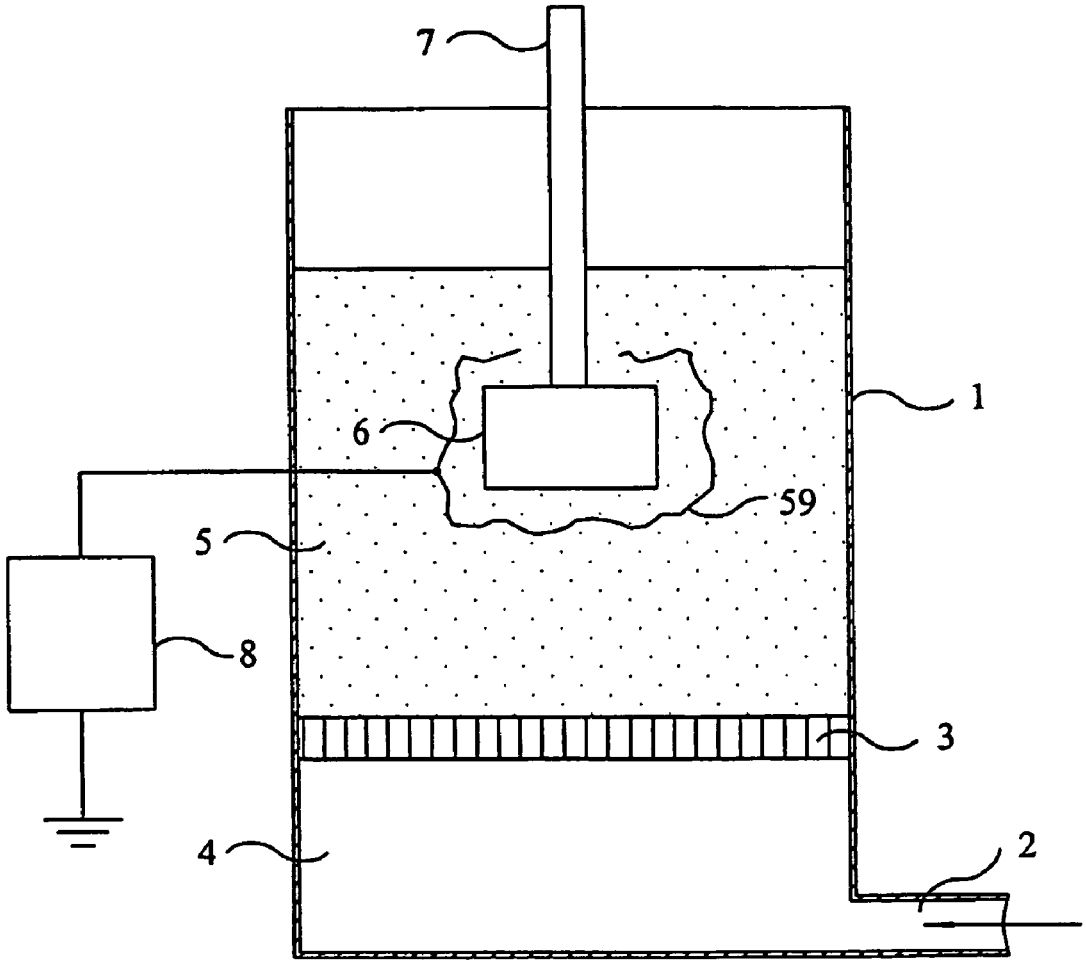
Figure 5:
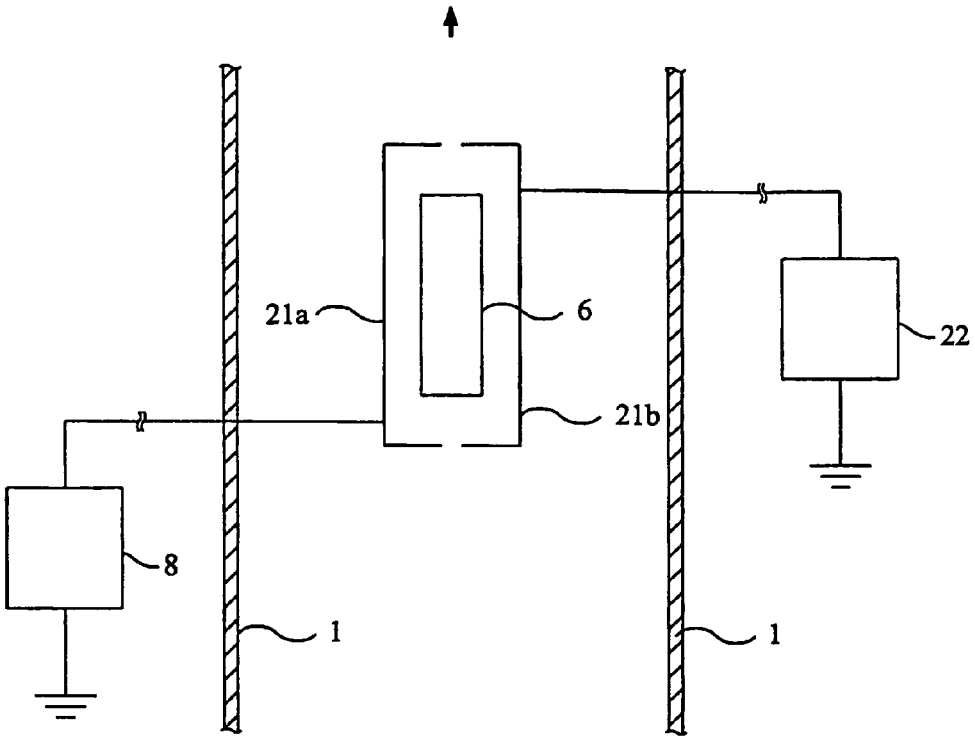
Figure 6:
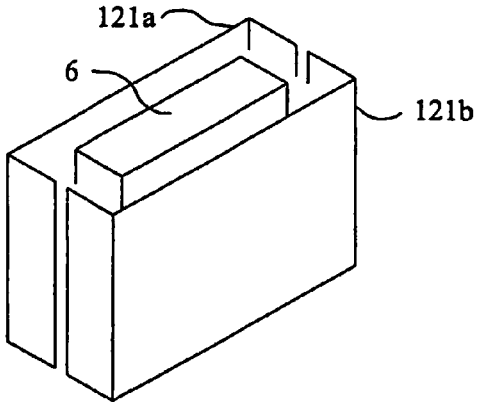
Figure 7:
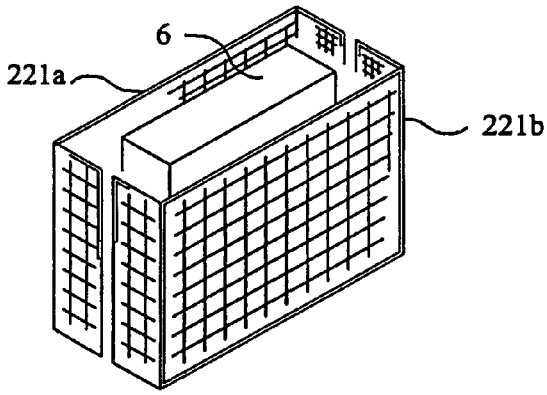
Figure 8:
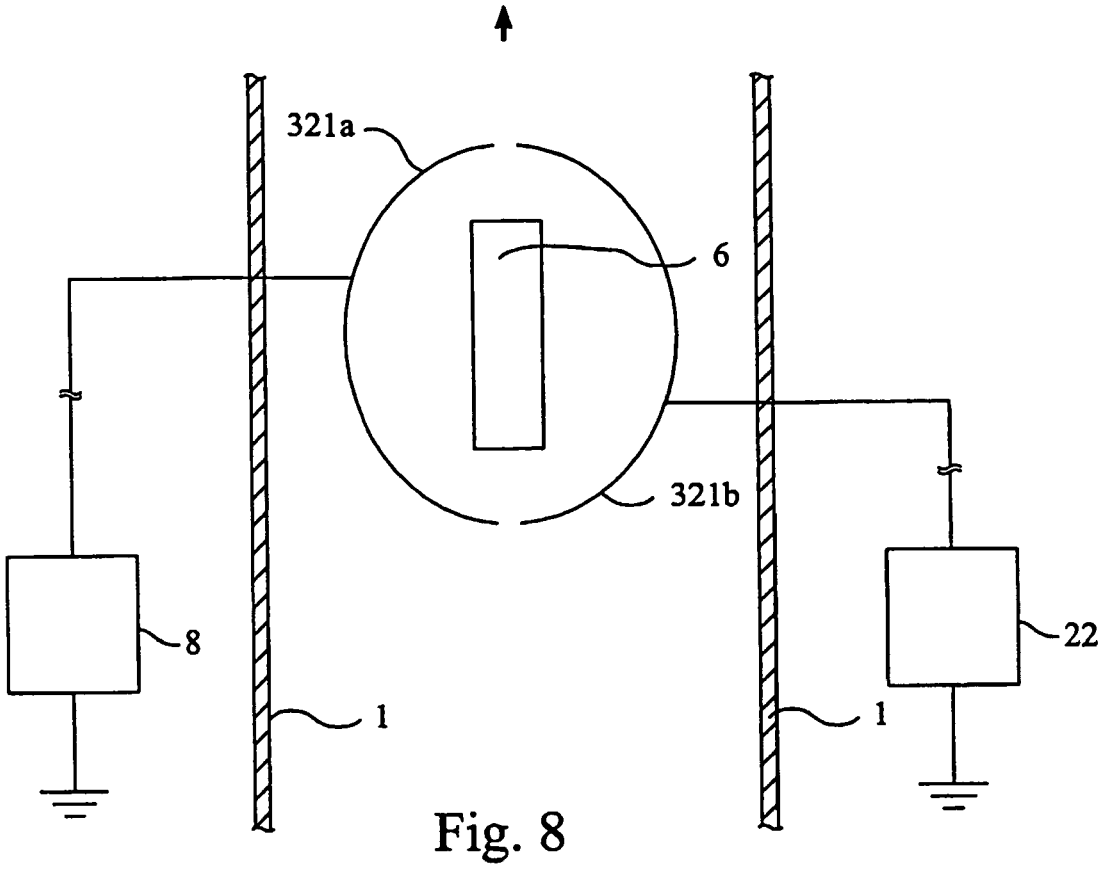
Figure 9:
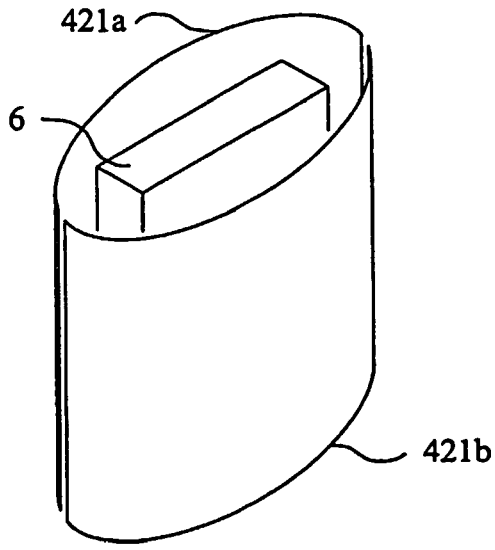
Figure 10:
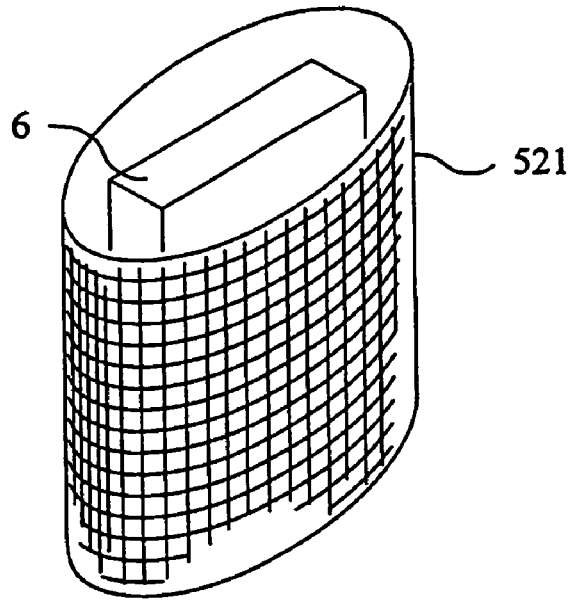
Figure 11:
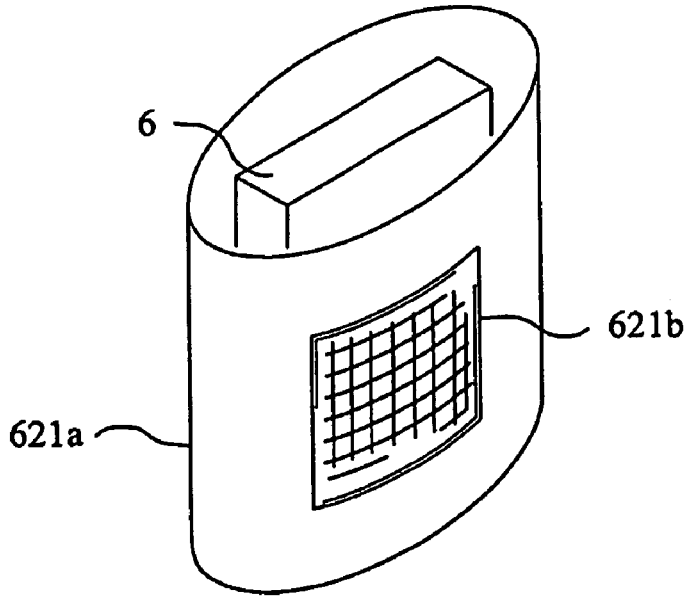
Figure 12:
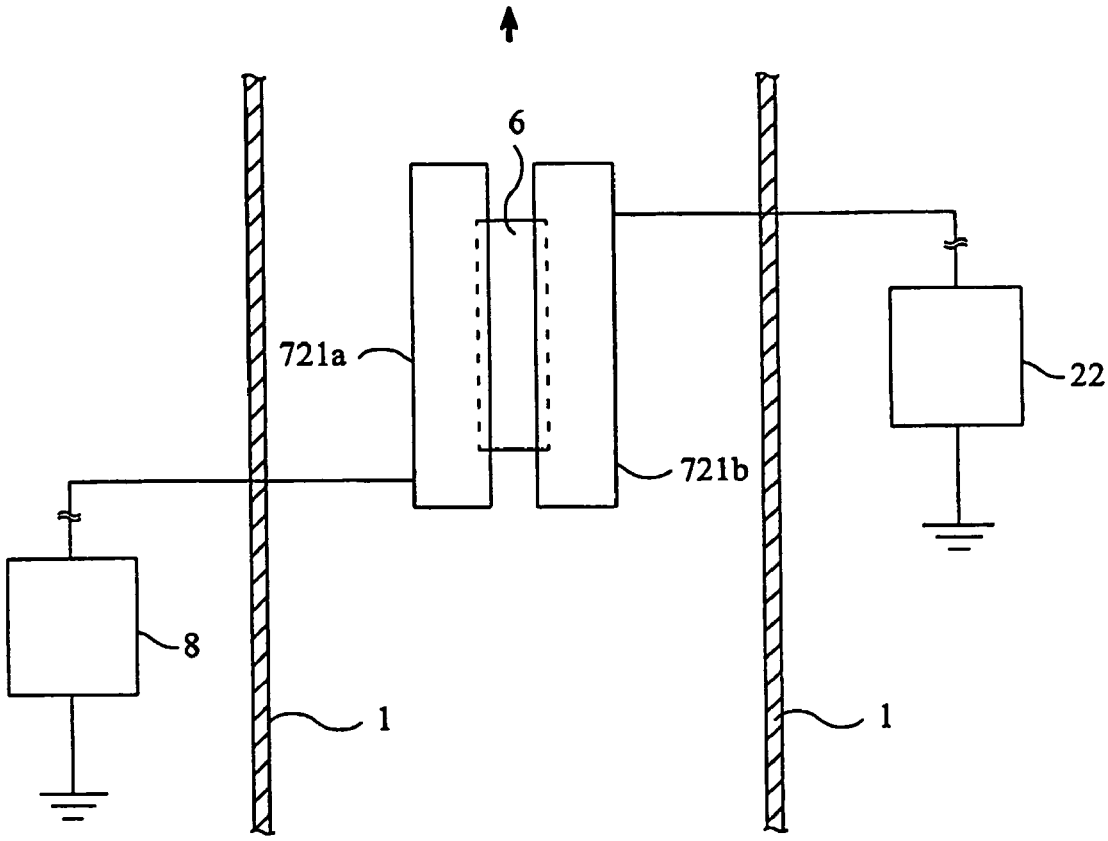
Figure 13:
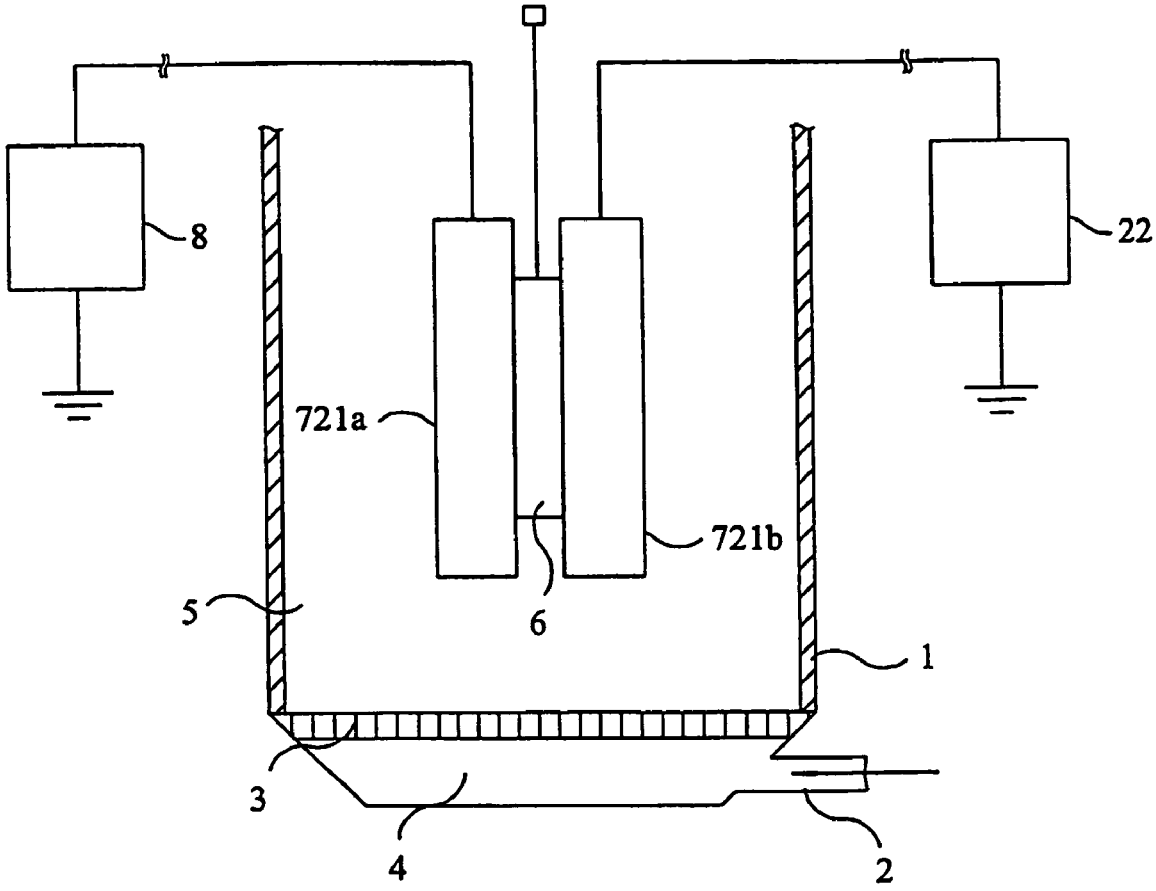
Figure 14:
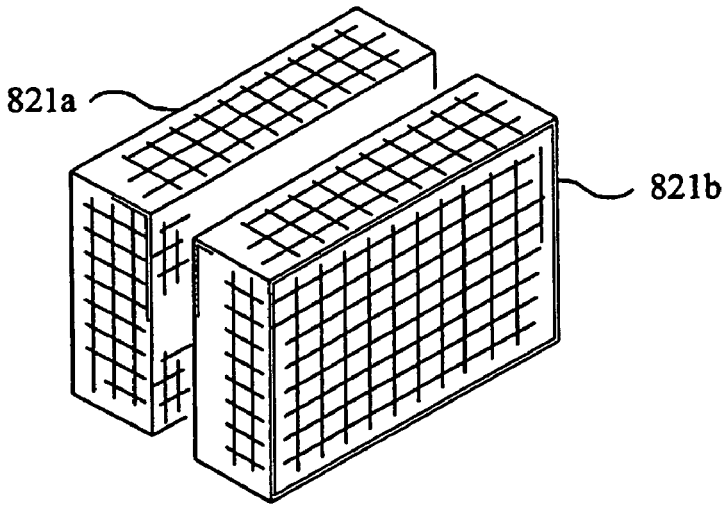

A fluidised-bed triboelectric powder coating apparatus including several forms of electrode in accordance with the invention and Examples of a process using the apparatus, will now be described, by way of example only, with reference to the accompanying drawings, in which:

FIG. 1 shows a side elevation of the fluidised-bed triboelectric powder coating apparatus, in diagrammatic section, including an electrode in the form of a rod seen end-on, FIG. 2 shows a side elevation of the fluidised-bed apparatus of FIG. 1, including an electrode in the form of a plate, seen edge-on, that is smaller than the substrate, FIG. 3 shows a side elevation of the fluidised-bed apparatus of FIG. 1, including a pair of electrodes in the form of plates, seen edge-on, that are larger than the substrate, FIG. 4 shows a side elevation of the fluidised-bed apparatus of FIG. 1, including an electrode in the form of a shell having no specific geometric form, FIG. 5 shows a plan view of a part of the fluidised-bed apparatus of FIG. 1 including a rectangular form of shell, FIG. 6 shows a perspective view of the rectangular form of shell of FIG. 5 constructed from sheet material, FIG. 7 shows a perspective view of the rectangular form of shell of FIG. 5 constructed from an array of rods, FIG. 8 shows a plan view of a part of the fluidised-bed apparatus of FIG. 1 including an oval form of shell, FIG. 9 shows a perspective view of the oval form of shell of FIG. 8 constructed from sheet material, FIG. 10 shows a perspective view of the oval form of shell of FIG. 8 constructed from an array of rods, FIG. 11 shows a perspective view of the oval form of shell of FIG. 8 constructed partly from sheet material and partly from an array of rods, FIG. 12 shows a plan view of a part of the fluidised-bed apparatus of FIG. 1 including a rectangular form of shell having, as viewed, top and bottom pieces, FIG. 13 shows a side elevation of the fluidised-bed triboelectric powder coating apparatus, in diagrammatic section, including a rectangular form of shell having, as viewed, top and bottom pieces and an earthed substrate and FIG. 14 shows a perspective view of the rectangular form of shell of FIG. 12 constructed from an array of rods.

Referring to FIG. 1 of the accompanying drawings, the fluidised-bed triboelectric powder coating apparatus includes a fluidising chamber 1 having an air inlet 2 at its base and a porous air distribution membrane 3 so disposed transversely as to divide the chamber into a lower plenum 4 and an upper fluidising compartment 5. A fluidised bed of a powder coating composition is established in the upper fluidising compartment 5 by means of an upwardly-flowing stream of air introduced from the lower plenum 4 through the porous membrane 3. The particles of the powder coating composition become electrically charged as a result of triboelectric action among the particles.

In the operation of the apparatus, a substrate 6 suspended from an insulated support 7, preferably a rigid support, is immersed in the fluidised bed.

The apparatus includes an electrically conductive electrode 9 in the form of a rod, shown end-on, adjacent to the substrate 6 and, for at least a part of the period of immersion, a direct voltage is applied to the electrode 9 by means of a voltage source 8, which may be a variable voltage source. As shown, the substrate 6 has no electrical connection (electrically "floating") but it may instead be earthed by a suitable electrical connection.

It has been found that better results are obtained when substrates which are electrical conductors are earthed rather than isolated and the same is true for substrates which have significant electrical conductivity while not being regarded as electrical conductors.

Triboelectrically charged particles of the powder coating composition adhere to the substrate 6. There are no ionisation or corona effects, the voltage supplied by the voltage source 8 being kept below the level required to generate such effects.

The substrate 6 along with the electrode 9 may be moved in a regular oscillatory manner during the coating process by means not shown in FIG. 1. Alternatively, the substrate 6 and the electrode 9 may be advanced through the bed either intermittently or continuously during immersion, or may be repeatedly immersed and withdrawn until a desired total period of immersion has been achieved. There is also the possibility of keeping the substrate 6 and electrode 9 still and moving the powder by vibrating the bed or stirring the bed with a propeller mixer.

After the desired period of immersion the substrate 6 is withdrawn from the fluidised bed and is heated to melt and fuse the adhering particles of the powder coating composition and complete the coating.

The voltage source 8 is mains-powered and the output voltage is measured relative to mains earth potential.

The following Examples illustrate the process of the invention, and were carried out using apparatus as shown in FIGS. 1 to 3 with a 1 cubic meter fluidising chamber or where indicated, a Nordson Corporation fluidisation unit, accommodating the weight of powder and the substrates specified.

The following formulation was used as the powder coating composition in all of the Examples:

| | Parts by weight |
|---|---|
| Rutile Titanium Dioxide | 321 |
| Filler (Dolomite) | 107 |
| Carboxylic Acid-functional Polyester Resin | 374 |
| Epoxy Resin Curing Agent | 152 |
| Catalyst | 30 |
| Wax | 3 |
| Flow Modifier | 10 |
| Benzoin | 3 |

In addition, the following additive formulation for post-blending was prepared and used:

Additive Formulation 1

Aluminium Oxide (Degussa Aluminium Oxide C)—45 parts by weight

Aluminium Hydroxide (Martnal OL107C)—55 parts by weight

The particle size distribution (PSD) of the powder coating system used in all Examples except Example 9A was as follows:

| | |
|---|---|
| $d(v)_{99}$, μm | 54.18 |
| $d(v)_{50}$, μm | 20.77 |
| % <10 μm | 16.83 |
| % <5 μm | 4.96 |

EXAMPLE 1A

The general operating conditions were as follows:

Weight of the powder loaded in the bed—350 kg

Free fluidisabon time for equilibrating the bed—30 min at 1 bar

Fluidising pressure—1 bar

Standard bake and cure of deposited material—30 min at 120° C.

The powder, with 0.6% of the additive formulation 1, was fluidised at 1 bar for 30 minutes prior to the commencement of coating, after which the coating was heated to 120° C. for 30 minutes. The coating results were monitored by measuring the width of the coating deposited.

The apparatus shown in FIG. 1 was used, the electrode being a cylindrical rod 1 cm in diameter and 55 cm long. The substrate was an aluminium panel of dimensions 80 cm by 60 cm by 2 mm, that is, the aluminium panel was larger than the rod electrode. The rod electrode was positioned roughly centrally in relation to the aluminium panel.

The results are set out in the table below:

| Distance from substrate (cm) | Applied voltage (kV) | Dip time (mins) | Comments |
|---|---|---|---|
| 33 | 2 | 3 | No coating |
| 20 | 6 | 5 | Coated a band in the middle of the panel 30 cm wide |
| 12 | 4 | 10 | Coated a band in the middle of the panel 25 cm wide |
| 12 | 2 | 10 | Coated a band in the middle of the panel 24 cm wide |

EXAMPLE 1B

The substrate was a piece of plywood board measuring 65 cm by 38 cm by 2 cm. The rod electrode was positioned roughly centrally in relation to the piece of plywood. The conditions were as for Example 1A above and the results are set out in the table below:

| Distance from substrate (cm) | Applied voltage (kV) | Dip time (mins) | Comments |
|---|---|---|---|
| 12 | 6 | 5 | Coated a band in the middle of the panel 36 cm wide |

The cylindrical rod used in Examples 1A and 1 B was of a diameter (1 cm) too large to lead to any ionisation or corona conditions on the powder coating composition, and any edges were masked with insulating tape to ensure that there could be no ionisation or corona conditions.

The maximum potential gradient used in Examples 1A and 1B was 0.5 kV/cm (6 kV applied with a spacing of 12 cm) which is well below the ionisation potential gradient of 30 kV/cm for air and, also, well below the potential gradient at which the electrode would function to ionise or otherwise charge the powder coating composition.

EXAMPLE 2A

Referring to FIG. 2 of the accompanying drawings, the apparatus includes an electrically conductive electrode 29 in the form of a panel, shown edge-on, adjacent to the substrate 6 and, for at least a part of the period of immersion, a direct voltage is applied to the electrode 29 by means of a voltage source 8, which may be a variable voltage source. As shown, the substrate 6 has no electrical connection (electrically "floating") but it may instead be earthed by a suitable electrical connection.

The apparatus shown in FIG. 2 was used, the electrode being an aluminium panel of dimensions 30 cm by 20 cm by 2 mm. The substrate was the aluminium panel used in Example 1A above, its dimensions being 80 cm by 60 cm by 2 mm, that is, larger than the panel electrode. The panel electrode was positioned roughly centrally in relation to the aluminium substrate panel. The surfaces of the panel electrode were smooth and the edges of the panel electrode were masked with insulating tape to ensure that there could be no ionisation or corona conditions.

The operating conditions were as for Example 1A above and the results are set out in the following table:

| Distance from substrate (cm) | Applied voltage (kV) | Dip time (mins) | Comments |
|---|---|---|---|
| 12 | 2 | 10 | Coated a band in the middle of the panel 33 cm wide |
| 12 | 4 | 10 | Coated a band in the middle of the panel 47 cm wide |
| 20 | 6 | 5 | Coated a band in the middle of the panel 52 cm wide |

EXAMPLE 2B

The substrate was the piece of plywood board measuring 65 cm by 38 cm by 2 cm used in Example 1B above. The panel electrode was positioned roughly centrally in relation to the piece of plywood. The conditions were as for Example 1A above and the results are set out in the table below:

| Distance from substrate (cm) | Applied voltage (kV) | Dip time (mins) | Comments |
|---|---|---|---|
| 12 | 6 | 5 | Coated a band in the middle of the panel 50 cm wide |

The maximum potential gradient used in Examples 2A and 2B was 0.5 kV/cm (6 kV applied with a spacing of 12 cm) which is well below the ionisation potential gradient of 30 kV/cm for air and, also, well below the potential gradient at which the electrode would function to ionise or otherwise charge the powder coating composition.

EXAMPLE 3A

In this Example, two panel electrodes were positioned side by side with a 10 cm gap between them. The voltages were applied to the panel electrodes by separate high-voltage dc supplies. The two-electrode arrangement was positioned centrally in relation to the aluminium substrate panel and the combined assembly immersed in the fluidised bed. The surfaces of the panel electrodes were smooth and the edges of the panel electrodes were masked with insulating tape to ensure that there could be no ionisation or corona conditions.

The operating conditions were as for Example 1A above.

The results show that the coated area can be built up from the centre of the substrate panel according to how many electrodes are provided, the effect of the multiple electrodes being set out in the following table:

| Distance from substrate (cm) | Applied voltage (kV) | Dip time (mins) | Comments |
|---|---|---|---|
| 12 | 4 | 10 | Coated a band in the middle of the panel 66 cm wide |

The coated band 66 cm in width compares favourably with a coated band 47 cm in width for Example 2A under comparable conditions.

EXAMPLE 3B

The substrate was the piece of plywood board measuring 65 cm by 38 cm by 2 cm used in Example 1B above. The panel electrodes were positioned as for Example 3A in relation to the piece of plywood. The conditions were as for Example 1A above and the results are set out in the table below:

| Distance from substrate (cm) | Applied voltage (kV) | Dip time (mins) | Comments |
|---|---|---|---|
| 12 | 6 | 5 | Coated a band in the middle of the panel 59 cm wide |

The coated band 59 cm in width compares favourably with a coated band 50 cm in width for Example 2B under comparable conditions. As is indicated above in relation to Example 3A, the results show that the coated area can be built up from the centre of the substrate panel according to how many electrodes are provided, The above Examples 3A and 3B using two panel electrodes show that coating was more efficient in effecting the coating of a wider band than was possible with a single panel electrode.

The maximum potential gradient used in Examples 3A and 3B was 0.5 kV/cm (6 kV applied with a spacing of 12 cm) which is well below the ionisation potential gradient of 30 kV/cm for air and, also, well below the potential gradient at which the electrode would function to ionise or otherwise charge the powder coating composition.

EXAMPLE 4

In Example 4, panel electrodes with different polarities were used, positioned on the same side of the plywood board substrate. A voltage of +6 kv was applied to one electrode and a voltage of −6 kV was applied to the other electrode. The electrodes were positioned 12 cm from the plywood board in the middle region of the plywood board and the board and electrodes immersed in the fluidised bed. The dip time was 10 minutes and the board was coated with two bands, one 32 cm wide and the other 21 cm wide with a non-coated strip 7 cm wide between the bands. The surfaces of the panel electrodes were smooth and the edges of the panel electrodes were masked with insulating tape to ensure that there could be no ionisation or corona conditions.

The Example illustrates that the use of two electrodes as specified permits the selective non-coating of parts of the substrate.

The maximum potential gradient used in the Example was 0.5 kV/cm (6 kV applied with a spacing of 12 cm) which is well below the ionisation potential gradient of 30 kV/cm for air and, also, well below the potential gradient at which the electrode would function to ionise or otherwise charge the powder coating composition.

EXAMPLE 5A

The arrangement shown in FIG. 3 of the accompanying drawings was used in this Example, plate electrodes 39 and 49, larger than the substrate 6, being used and the plate electrode 49 being energised by a second high-voltage source 22. The surfaces of the plate electrodes were smooth and the edges of the plate electrodes were masked with insulating tape to ensure that there could be no ionisation or corona conditions.

For this Example, 350 kg of the powder formulation given above was fluidised in a 1 cubic meter fluidised bed at 1 bar pressure and two plate electrodes of 1.2 m by 0.8 m by 2 mm were submerged in the fluidised powder. A 30 cm by 30 cm by 2 mm aluminium panel substrate was positioned between the plate electrodes 25 cm from each plate electrode and earthed. The substrate was dipped for 5 minutes in the presence of the electrode voltages set out below and the coated substrate was then heated for 15 minutes at 200 C. The coverage and the film thickness were measured across the whole face of both sides of the substrate.

The results are set out in the following table:

| Electrode | Electrode to panel distance (cm) | Electrode voltage (kV) | Coverage (%) | Average film thickness (μm) | Standard deviation |
|---|---|---|---|---|---|
| 1 | 25 | 2.2 | 34 | 23 | 28 |
| 2 | 25 | 2.2 | 38 | 21 | 25 |
| 1 | 25 | 2.2 | 33 | 14 | 17 |
| 2 | 25 | 1 | 19 | 12 | 17 |
| 1 | 25 | 3 | 55 | 26 | 26 |
| 2 | 25 | 1 | 38 | 15 | 18 |
| 1 | 25 | 4 | 51 | 47 | 23 |
| 2 | 25 | 2 | 35 | 31 | 33 |

The results for Example 5A show that the deposition is the same on both sides of the panel substrate when the electrode voltages are the same. If, however, the voltages are different, the coating is preferential on the side of the panel substrate that faces the higher-voltage electrode. The difference in the coating rate on the two faces of the substrate is increased by increasing the voltage difference between the electrodes.

The maximum potential gradient used in Example 5A was 0.16 kV/cm (4 kV applied with a spacing of 25 cm) which is well below the ionisation potential gradient of 30 kV/cm for air and, also, well below the potential gradient at which the electrode would function to ionise or otherwise charge the powder coating composition.

EXAMPLE 5B

Example 5B was carried out using apparatus arranged as shown in FIG. 3, employing a fluidisation unit supplied by the Nordson Corporation having a generally cylindrical chamber of height 25 cm and diameter 15 cm. The substrate was a piece of MDF board 10 cm square and 2 cm thick. The amount of powder used was 500 grams, since the fluidising chamber was smaller than that used for Example 5A. The dip time 2 minutes. The results are set out in the following table:

| Electrode | Electrode-to-panel distance | Electrode voltage | Coverage | Average film thickness μm |
|---|---|---|---|---|
| 1 | 2 cm | +2 kV | 100% | 17 |
| 2 | 2 cm | +4 kV | 100% | 26 |

EXAMPLE 6A

The apparatus used in this Example is the same as that used in Example 5A above, but the distance of plate electrode 1 from the panel substrate was varied while the distance of plate electrode 2 from the substrate was kept fixed. The aluminium panel served as the substrate. The results are set out in the following table:

| Electrode | Electrode to panel distance (cm) | Electrode voltage (kV) | Coverage (%) | Average film thickness (μm) | Standard deviation |
|---|---|---|---|---|---|
| 1 | 25 | 3 | 82 | 50 | 27 |
| 2 | 20 | 3 | 82 | 46 | 35 |
| 1 | 40 | 3 | 45 | 23 | 24 |
| 2 | 20 | 3 | 27 | 32 | 27 |

EXAMPLE 6B

The apparatus used in this Example was the same as that used in Example 6A above, the distance of plate electrode 1 from the panel substrate was varied while the distance of plate electrode 2 from the substrate was kept fixed but with a larger spacing for electrode 2 than in Example 6A. The aluminium panel served as the substrate. The results are set out in the following table:

| Electrode | Electrode to panel distance (cm) | Electrode voltage (kV) | Coverage (%) | Average film thickness (μm) | Standard deviation |
|---|---|---|---|---|---|
| 1 | 17 | 3 | 73 | 45 | 30 |
| 2 | 35 | 3 | 100 | 46 | 25 |
| 1 | 28 | 3 | 98 | 31 | 18 |
| 2 | 35 | 3 | 39 | 18 | 21 |

The results of Examples 6A and 6B show that, for the aluminium panel substrate, as the spacing between electrode 1 and the substrate was varied, the coating rate on both sides of the substrate was affected. The coating rate on the side of the substrate facing electrode 1 did not fall progressively with increasing distance of electrode 1 from the substrate and there were optimum "spacing pairs" for which the coating rates on both sides were comparable and relatively high in relation to other "spacing pairs". Additionally, the results show that different coating rates and, consequently, different coating thicknesses may be achieved on opposite sides of the aluminium plate substrate should that be desired.

The maximum potential gradient used in Examples 6A and 6B was 0.18 kV/cm (3 kV applied with a spacing of 17 cm) which is well below the ionisation potential gradient of 30 kV/cm for air and, also, well below the potential gradient at which the electrode would function to ionise or otherwise charge the powder coating composition.

EXAMPLE 7A

The apparatus used for Example 5A was used for this Example, the voltages applied to the two electrodes being of opposite polarities and being varied while the distances between the electrodes and the substrate were the same (25 cm) and was not varied. The operating conditions were as for Example 5A and the aluminium panel served as the substrate. The results are set out in the following table:

| Electrode | Electrode to panel distance (cm) | Electrode voltage (kV) | Coverage (%) | Average film thickness (μm) | Standard deviation |
|---|---|---|---|---|---|
| 1 | 25 | −1 | 3 | 4 | 2 |
| 2 | 25 | +1 | 6 | 5 | 3 |
| 1 | 25 | −2 | 2 | 4 | 3 |
| 2 | 25 | +4 | 2 | 7 | 12 |
| 1 | 25 | −1 | 0 | 20 | 4 |
| 2 | 25 | +2 | 30 | 7 | 5 |
| 1 | 25 | −1 | 25 | 11 | 13 |
| 2 | 25 | +5 | 30 | 17 | 17 |

The results show that, for the aluminium panel substrate, the coating rate is significantly less on both sides of the substrate when opposite polarities are applied to the electrodes than when similar polarities are applied to the electrodes. The results may be applicable in circumstances where significantly lower coating rates that are unequal are desired.

The maximum potential gradient used in Example 7A was 0.2 kV/cm (5 kV applied with a spacing of 25 cm) which is well below the ionisation potential gradient of 30 kV/cm for air and, also, well below the potential gradient at which the electrode would function to ionise or otherwise charge the powder coating composition.

EXAMPLE 7B

Example 7B was carried out using apparatus arranged as shown in FIG. 3, employing a fluidisation unit supplied by the Nordson Corporation having a generally cylindrical chamber of height 25 cm and diameter 15 cm. The substrate was a piece of MDF board 10 cm square and 2 cm thick. The amount of powder used was 500 grams, since the fluidising chamber was smaller than that used for Example 7A The dip time 2 minutes. The results are set out in the following table:

| Electrode | Electrode-to-panel distance | Electrode voltage | Coverage | Average film thickness μm |
|---|---|---|---|---|
| 1 | 2 cm | +2 kV | 100% | 26 |
| 2 | 2 cm | −2 kV | 100% | 13 |

In comparison with the results obtained in Example 7A when an aluminium substrate was used and the opposing electric fields partially cancelled each other at the substrate, causing lower deposition efficiency, significantly higher coating rates are achieved with the MDF substrate. The difference is considered to arise from the MDF presenting a higher electrical resistance than the aluminium, permitting significantly different electric fields on the faces of the MDF board.

EXAMPLE 8A

The fluidising chamber and the operating conditions for Example 1A were used for this Example but the substrate was a hollow aluminium cylinder of diameter 5 cm, length 25 cm with open ends. The electrodes were two panel electrodes 1.2 m by 0.8 m positioned 50 cm apart.

The cylinder substrate was immersed in the fluidised bed between the two panel electrodes and a voltage of 3 kV was applied to each electrode for a period of 5 mins.

The hollow cylinder substrate was observed to be coated evenly on the outside but, on the inside, an even coating extended to only 7 cm from the open ends. The remainder of the internal surface was left uncoated.

EXAMPLE 8B

The fluidising chamber, the hollow cylinder substrate and the operating conditions of Example 8A were used but the two panel electrodes were replaced by a single rod electrode inserted centrally into the hollow cylinder substrate, and 3 kV applied to the rod electrode for 5 mins. The hollow cylinder substrate was observed to be coated evenly and completely throughout its interior.

EXAMPLE 9A

Example 9A was carried out using apparatus arranged as shown in FIG. 3, employing a fluidisation unit supplied by the Nordson Corporation having a generally cylindrical chamber of height 25 cm and diameter 15 cm. The substrate was a piece of aluminium 10 cm square and 2 cm thick.

The amount of powder was 300 grams. The particle size distribution (PSD) of the powder was as follows:

| | |
|---|---|
| $d(v)_{99}$ μm | 10 |
| $d(v)_{50}$ μm | 5.5 |
| % <5 μm | 42 |

The following additive was prepared, all amounts being by weight:

| | |
|---|---|
| Aluminium oxide | 15 parts |
| Aluminium Hydroxide | 45 parts |
| Silica | 40 parts |

The silica was hydrophobic silica as defined above.

An amount of the additive amounting to 2%, based on the total weight of the composition without the additive, was added to the 300 grams of powder by post-blending and the mixture tumble mixed for 30 mins. The mixture was fluidised in the fluidising chamber.

Two 10 cm square electrodes were placed 6 cm apart in the centre of the fluidised bed and the 10 cm square aluminium substrate immersed in the bed between the two electrodes to both of which 3 kV was applied for 2 mins.

The substrate was observed to become fully coated and to include a thickening of the covering along the edges, giving a "picture frame" effect.

EXAMPLE 9B

In Example 9B, a PTFE sheet 2 mm thick was inserted around the internal wall of the fluidising chamber used in Example 9A, electrically insulating the wall of the fluidising chamber.

A procedure as for Example 9A was carried out The substrate was observed to become evenly coated over its surface and edges (100%) without any thickening, that is, without "picture framing" effect.

The above Examples 9A and 9B show that a conductive wall in a fluidising chamber exercise an effect on the coating of the substrate, especially when the wall is close to edges of the substrate. The effect of the conductive wall on the electric field gives rise to uneven coverage at the edges closer to the wall. Insulating of the walls of the fluidising chamber allows the electric field to be shaped more or less exclusively by the electrodes, in which case highly even coverage is achieved.

Since there may be instances where some thickening of the coating along the edges of the substrate is desirable and other where thickening is not desirable, the possibility exists for apparatus including either conductive or insulating fluidising chambers.

Composite electrodes may be constructed from the electrodes disclosed in the above Examples.

One composite electrode arrangement includes a plurality of panel electrodes separated from one another by insulating material, allowing the application of different voltages to the respective electrodes. The voltages applied to the panel electrodes may range from very low voltages to several kilovolts, according to the desired results. The insulating material is arranged to prevent any charging or corona conditions from the edges of the panel electrodes the edges of which may be covered with insulating tape as necessary to ensure that here are no charging or corona conditions. One or more, but not all, of the panel electrodes of a composite electrode may be earthed.

An alternative composite electrode arrangement is a plurality of panel electrodes the edges of which overlap one another without the panel electrodes actually touching one another. Insulating material may be included to mask the edges of the panel electrodes to ensure that there are no charging or corona conditions and, also, to guard against electrical contact even if there is mechanical contact between the panel electrodes. Voltages ranging from a few volts to several kilovolts may be applied to the panel electrodes according to the desired results. One or more, but not all, of the panel electrodes of a composite electrode may be earthed.

Composite electrodes would be useful in circumstances where it was desired that the coating on the substrate should be tailored in some way, for example, in order to obtain a coating with reduced thickness at the edge of the substrate.

The rod electrode disclosed in Examples 1A and 1B may be used in coating a plane substrate or a slightly curved substrate but, as in the case of Example 8B, is especially suitable for coating a recess in a substrate when inserted into the recess. The recess may, of course, be a recess which is open on one side or closed on all sides.

The electrodes disclosed in the above Examples may be modified to form a shell for a substrate, especially a substrate which is not a plate, the shell partially or completely accommodating the substrate.

The development of an electrode or electrodes into a shell for a substrate may be accomplished by increasing the number of electrodes, including joining a plurality of rod electrodes together to form a mesh, for example, or, alternatively, extending a plate electrode or a plurality of plate electrodes in order to confront the substrate on all sides.

Referring to FIG. 4 of the accompanying drawings, as in FIG. 1, the fluidised-bed triboelectric powder coating apparatus includes a fluidising chamber 1 having an air inlet 2 at its base and a porous air distribution membrane 3 so disposed transversely as to divide the chamber into a lower plenum 4 and an upper fluidising compartment 5. A fluidised bed of a powder coating composition is established in the upper fluidising compartment 5 by means of an upwardly-flowing stream of air introduced from the lower plenum 4 through the porous membrane 3. The particles of the powder coating composition become electrically charged as a result of triboelectric action among the particles.

In the operation of the apparatus, a substrate 6 suspended from an insulated support 7, preferably a rigid support, is immersed in the fluidised bed.

The apparatus includes an electrically conductive electrode 59 having no specific form, encompassing the substrate 6 and, for at least a part of the period of immersion, a direct voltage is applied to the electrode 59 by means of a voltage source 8, which may be a variable voltage source. As shown, the substrate 6 has no electrical connection (electrically "floating") but it may instead be earthed by a suitable electrical connection.

Referring to FIG. 5 of the accompanying drawings, the apparatus including an electrode for coating a rectangular substrate 6, includes a rectangular shell having first and second portions 21*a* and 21*b*. The shell fits closely to the rectangular the substrate 6 without covering the top, as viewed in the figure, of the substrate 6. Although not evident from the figure, the shell does not cover the bottom of the substrate. The shell has four internal surfaces facing four side faces, as viewed, of the substrate 6. The first portion 21*a* of the shell is connected to a first power source 8 and the second portion 21*b* of the shell is connected to a second power source 22. There is a gap between the portions 21*a* and 21*b* of the shell which are, as a result of the gap, electrically isolated from each other. The substrate 6 is electrically isolated.

Referring to FIG. 6 of the accompanying drawings, the rectangular shell is shown in perspective and, in this instance, is constructed from an array of rods, the shell including a first portion 121*a* and a second portion 121*b* between which there is a gap.

Referring to FIG. 7 of the accompanying drawings, the rectangular shell, shown again in perspective, is in this instance constructed from an array of rods and includes a first portion 221*a* and a second portion 221*b* between which there is a gap.

Referring to FIG. 8 of the accompanying drawings, the apparatus includes an oval shell enclosing the rectangular substrate 6. The oval shell includes a first portion 321*a* and a second portion 321*b* and encloses the substrate 6 without covering the top, as viewed in the figure, of the substrate 6. Although not evident from the figure, the shell does not cover the bottom of the substrate 6. The first portion 321*a* of the shell is connected to a first power source 8 and the second portion 321*b* of the shell is connected to a second power source 22. There is a gap between the portions 321*a* and 321*b* of the shell and the portions of the shell are, as a result of the gap, electrically isolated from each other.

Referring to FIG. 9 of the accompanying drawings, the oval shell is shown in perspective and, in this instance, is constructed from sheet material, the shell including a first portion 421*a* and a second portion 421*b* between which there is a gap.

Referring to FIG. 10 of the accompanying drawings, an alternative form of the oval shell is shown in perspective and, in this instance, is constructed from an array of rods, the shell including a single portion 521.

Referring to FIG. 11 of the accompanying drawings, another alternative form of the oval shell is shown in perspective and, in this instance, is a single piece of material including a principal area 621*a* of sheet material and an area 621*b* formed by an array of rods.

Referring to FIG. 12 of the accompanying drawings, the apparatus includes a rectangular shell, including a first portion 721*a* and a second portion 721*b*, which surrounds the substrate 6 including covering the top, as viewed in the figure, of the substrate 6. The substrate 6 is rectangular. Although not evident from the figure, the shell also covers the bottom of the substrate 6. The first portion 721*a* of the shell is connected to a first power source 8 and the second portion 721*b* of the shell s connected to a second power source 22. There is a gap between the portions 721*a* and 721*b* of the shell and the portions of the shell are, as a result of the gap, electrically isolated from each other.

Referring to FIG. 13 of the accompanying drawings, the substrate 6 is earthed while being provided with the shell consisting of the portions 721*a* and 721*b* which cover the top and bottom, as viewed, of the substrate 6.

Referring to FIG. 14 of the accompanying drawings, an alternative form of the rectangular shell is shown in perspective and, in this instance, is constructed from an array of rods, the shell including a first portion 821*a* and a second portion 821*b* which, in use, cover the top and bottom of the substrate.

The fluidising chamber 1 may be partly or wholly electrically conductive, in which case an electrical potential may be applied to the fluidising chamber also.

The shell need not be of any specific geometrical form. The shell includes a cavity in which, in operation, the substrate is wholly or partially accommodated. The boundary of the cavity may follow, but need not follow, the contours of the substrate.

It will be appreciated that there is a space between the electrode, or the electrodes, and the substrate in all of the above arrangements.

The invention claimed is:

1. An apparatus for performing a process for forming a coating on a substrate, including:

a fluidising chamber for establishing a fluidised-bed comprising a fluidising gas and a powder coating composition, thereby effecting tribostatic charging of the powder coating composition, means for immersing the substrate wholly or partly in the fluidised bed, whereby tribostatically charged particles of the powder coating composition adhere to the substrate, the substrate being either electrically isolated or earthed, an electrically conductive electrode, to which a voltage is applied, positioned to influence the extent to which charged particles adhere to a region of the substrate, means for applying the voltage to the electrode, means for withdrawing the substrate from the fluidised-bed and means for forming the adherent particles into a continuous coating over at least part of the substrate, the apparatus being arranged such that the maximum potential gradient existing in the fluidised bed is below the ionisation potential of the fluidising gas.

2. An apparatus as claimed in claim 1, including a second electrode to which is applied a voltage that is of polarity opposite to the first-identified voltage, the first-identified electrode and the second electrode being on opposite sides of the substrate and the second electrode being positioned to influence the extent to which charged particles adhere to a region of the substrate, and means for applying the voltage of the opposite polarity to the second electrode.

3. An apparatus as claimed in claim 1, including at least one further electrode adjacent to the first-identified electrode, the further electrode or electrodes being positioned to influence the extent to which charged particles adhere to a respective region of the substrate or respective regions of the substrate, and means for applying a voltage of the same polarity as the first-identified voltage to the further electrode or electrodes.

4. An apparatus as claimed in claim 3, including a plurality of further electrodes, wherein the further electrodes encompass the substrate.

5. An apparatus as claimed in claim 1, wherein the first-identified electrode is in the form of a rod.

6. An apparatus as claimed in claim 1, wherein the first-identified electrode is in the form of a plate.

7. An apparatus as claimed in claim 2, wherein the electrodes are in the form of plates.

8. An apparatus as claimed in claim 4, wherein the first-identified electrode and the plurality of further electrodes are elements of a shell encompassing the substrate.

9. An apparatus as claimed in claim 1, wherein the electrode forms a shell for the substrate.

10. An apparatus as claimed in claim 9, wherein the shell includes sheet material.

11. An apparatus as claimed in claim 8, wherein at least part of the shell consists of an array of rods.

12. An apparatus as claimed in claim 8, wherein the shell is tubular in form.

13. An apparatus claimed in claim 8, wherein the shell is tubular in form and includes an end closure member at one end.

14. An apparatus as claimed in claim 8, wherein the shell is tubular in form and includes end closure members at both ends.

15. An apparatus as claimed in claim 8, wherein the shell is cylindrical.

16. An apparatus as claimed in claim 8, wherein the shell has a circular transverse cross-section.

17. An apparatus as claimed in claim 8, wherein the shell has an oval transverse cross-section.

18. An apparatus as claimed in claim 8, wherein the shell has a rectangular transverse cross-section.

19. An apparatus as claimed in claim 8, wherein the shell has a plurality of electrically isolated portions and wherein the apparatus includes means for applying respective voltages to the separate portions.

20. An apparatus as claimed in claim 1, wherein at least a part of the fluidising chamber is electrically conductive and wherein the apparatus includes means for applying a voltage to the conductive part of the fluidising chamber.

21. An apparatus as claimed in claim 1, wherein the walls of the fluidising chamber are electrically non-conductive.

22. A process for forming a coating on a substrate, including the steps of:

establishing a fluidised bed comprising a fluidising gas and a powder coating composition, thereby effecting tribostatic charging of the powder coating composition, immersing the substrate wholly or partly in the fluidised bed, whereby tribostatically charged particles of the powder coating composition adhere to the substrate, the substrate being either electrically isolated or earthed, providing an electrically conductive electrode in the fluidised bed, applying a voltage to the electrically conductive electrode, the electrode being positioned, in relation to the substrate, where the extent to which charged particles adhere to regions of the substrate is influenced by the electrode, withdrawing the substrate from the fluidised-bed and forming the adherent particles into a continuous coating over at least part of the substrate, the process being conducted such that the maximum potential gradient existing in the fluidised bed is below the ionisation potential of the fluidising gas.

23. A process as claimed in claim 22, including the insertion of a second electrode on the opposite side of the substrate relative to the first-identified electrode, the second electrode being positioned to influence the extent to which charged particles adhere to a region of the substrate, and applying, to the second electrode, a voltage that is of polarity opposite to the first-identified voltage.

24. A process as claimed in claim 22, including the insertion of at least one further electrode adjacent to the first-identified electrode, the further electrode or electrodes being positioned to influence the extent to which charged particles adhere to a respective region of the substrate or respective regions of the substrate, and applying, to the further electrode or electrodes, a voltage of the same polarity as the first-identified voltage.

25. A process as claimed in claim 22, wherein the substrate is either electrically non-conductive or poorly conductive.

26. A process as claimed in claim 22, wherein the substrate comprises a medium density fibreboard (MDF).

27. A process as claimed in claim 22, wherein the substrate comprises wood.

28. A process as claimed in claim 22, wherein the substrate comprises a wood product.

29. A process as claimed in claim 22, wherein the substrate comprises a plastics material.

30. A process as claimed in claim 29, wherein the substrate comprises a plastics material including an electrically conductive additive.

31. A process as claimed in claim 29, wherein the plastics material comprises polyamide.

32. A process as claimed in claim 22, wherein the substrate comprises a plastics material having a surface resistance above $10^{11}$ ohms/square.

33. A process as claimed in claim 32, wherein the plastics material comprises polycarbonate.

34. A process as claimed in claim 22, wherein the surface resistance of the substrate is of the order of at least $10^3$ ohms/square.

35. A process as claimed in claim 22, wherein the surface resistance of the substrate is of the order of from $10^3$ to $10^5$ ohms/square.

36. A process as claimed in claim 22, wherein the surface. resistance of the substrate is of the order of at least $10^5$ ohms/square.

37. A process as claimed in claim 22, wherein the surface resistance of the substrate is of the order of from $10^5$ to $10^{11}$ ohms/square.

38. A process as claimed in claim 22, wherein the surface resistance of the substrate is of the order of at least $10^{11}$ ohms/square.

39. A process as claimed in claim 22, wherein the substrate is an electrically conductive substrate.

40. A process as claimed in claim 29, including the step of heating the plastics material to a temperature below its melting point and below the transition point of the powder coating composition before immersing the substrate in the fluidised bed.

41. A process as claimed in claim 29, including the step of pre-charging the substrate before immersing it in the fluidised bed.

42. A process as claimed in claim 41, including the step of equalising the charge on the substrate before immersing the substrate in the fluidised bed.

43. A process as claimed in claim 42, including the step of heating the substrate to a temperature below its melting point in order to equalise the charge.

44. A process as claimed in claim 42, including the step of moistening the surface of the substrate in order to equalise the charge.

45. A process as claimed in claim 22, wherein there is no preheating of the substrate prior to immersion in the fluidised bed.

46. A process as claimed in claim 22, wherein the potential gradient between the electrode or electrodes and the substrate is of the order of between 0.1 kV/cm and 5 kV/cm, both limits included.

47. A process as claimed in claim 46, wherein the potential gradient is of the order of between 0.1 kV/cm and 0.5 kV/cm, both limits included.

48. An apparatus as claimed in claim 46, wherein the potential gradient is of the order of between 0.2 kV/cm and 1 kV/cm, both limits included.

* * * * *